US005191838A

United States Patent [19]

Hansen

[11] Patent Number: 5,191,838

[45] Date of Patent: Mar. 9, 1993

[54] RAIL CLIP APPLICATOR AND METHOD OF APPLYING RAIL CLIPS

[75] Inventor: Kevin A. Hansen, Ludington, Mich.

[73] Assignee: Pandrol Jackson, Inc., Ludington, Mich.

[21] Appl. No.: 709,640

[22] Filed: Jun. 30, 1991

[51] Int. Cl.[5] ..... E01B 29/24; E01B 29/04

[52] U.S. Cl. ..... 104/2; 604/17.2; 604/279; 604/307

[58] Field of Search ..... 104/2, 9, 16, 17.1, 104/17.2, 279, 307

[56] References Cited

U.S. PATENT DOCUMENTS

| | | | |
|---|---|---|---|
| 3,004,716 | 10/1961 | Pande-Rolfsen | 238/349 |
| 3,297,253 | 1/1967 | Astley et al. | 238/349 |
| 3,658,246 | 4/1972 | Davies | 238/349 |
| 3,866,539 | 2/1975 | Gasse | 104/279 X |
| 4,068,593 | 1/1978 | Leeves | 104/307 |
| 4,240,667 | 12/1980 | Sedlaczek et al. | 104/279 X |
| 4,319,392 | 3/1982 | Cutts | 104/17.2 |
| 4,320,707 | 3/1982 | McIlrath | 104/17.2 X |
| 4,349,151 | 9/1982 | Schumaker | 238/349 |
| 4,413,777 | 11/1983 | Brown | 238/349 |
| 4,450,771 | 5/1984 | Theurer et al. | 104/307 |
| 4,466,656 | 8/1984 | Taylor | 238/1 |
| 4,479,440 | 10/1984 | Burr et al. | 104/307 |
| 4,513,912 | 4/1985 | Schumaker | 238/349 |
| 4,890,558 | 1/1990 | Quella et al. | 104/2 X |
| 4,966,080 | 10/1990 | Teissie et al. | 105/29.1 |
| 4,974,518 | 12/1990 | Cotic et al. | 104/16 |

FOREIGN PATENT DOCUMENTS

| | | | |
|---|---|---|---|
| 2102863 | 2/1983 | United Kingdom | 104/17.2 |

OTHER PUBLICATIONS

Photograph of "Pandriver Mk Vc" clip driving machine, Pandrol International Ltd.

Brochure entitled "The Pandrol system," Pandrol International Ltd.

Brochure entitled "Permaclipper," Permaquip Fairmont, division of Harsco Corp.

Photographs of "automatic Track Fastening Systems" machine, Pandrol International Ltd.

*Primary Examiner*—Robert J. Oberleitner

*Assistant Examiner*—S. Joseph Morano

*Attorney, Agent, or Firm*—Warner Norcross & Judd

[57] ABSTRACT

A rail clip applicator for automatically positioning and installing spring clips into the shoudlers of rail ties for securing rails to the ties. A superstructure rolls along the track from tie to tie carrying a large supply of clips. The superstructure carries two carrier frames. Each carrier frame carries two applicator assemblies disposed on either side of a track rail. Each applicator assembly carries a clip magazine and a head assembly, the head assembly carrying a clip shuttle, a drive block, and a backup block. Clips are loaded into the magazine. From the magazine, clips are serially dispensed to a clip grasping means at the end of a clip shuttle arm. The arm extends to hole the clip in position for being driven into a tie shoulder. The backup block presses against the rear of the shoulder, and the drive block moves the clip from the clip graspign means into the shoulder. The applicator assemblies and head assemblies are moutned such that they automatically position themselves correctly with respect to the tie shoulders. Clips are positioned and installed substantially simultaneously into four shoulders.

57 Claims, 21 Drawing Sheets

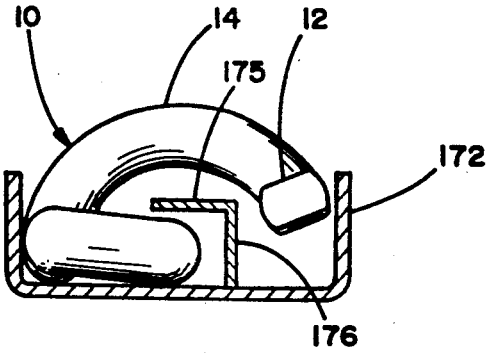
FIG. 14
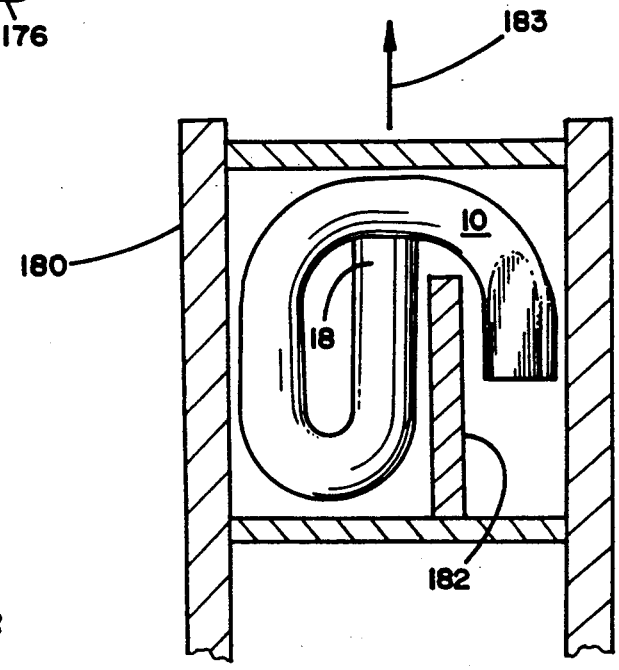
FIG. 15
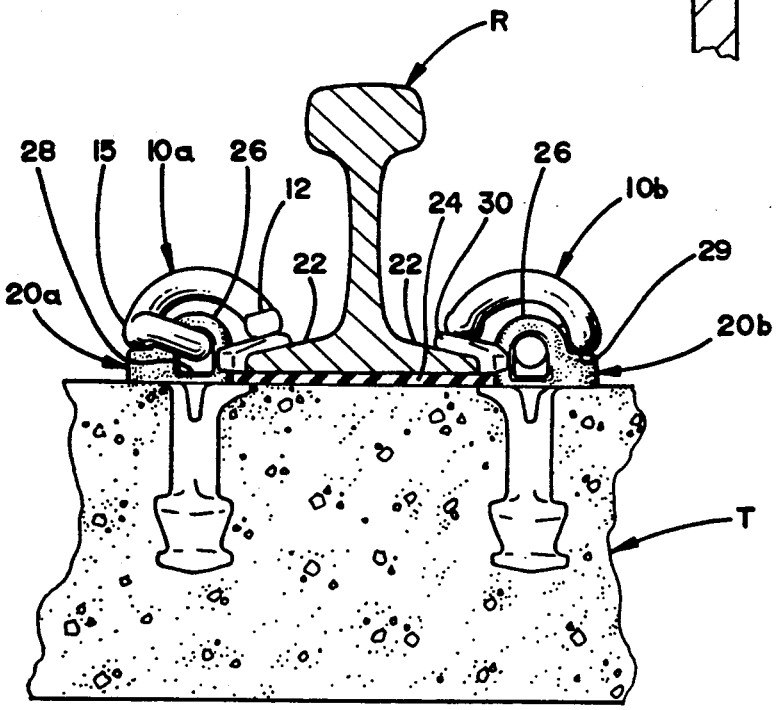
(PRIOR ART) FIG. 26

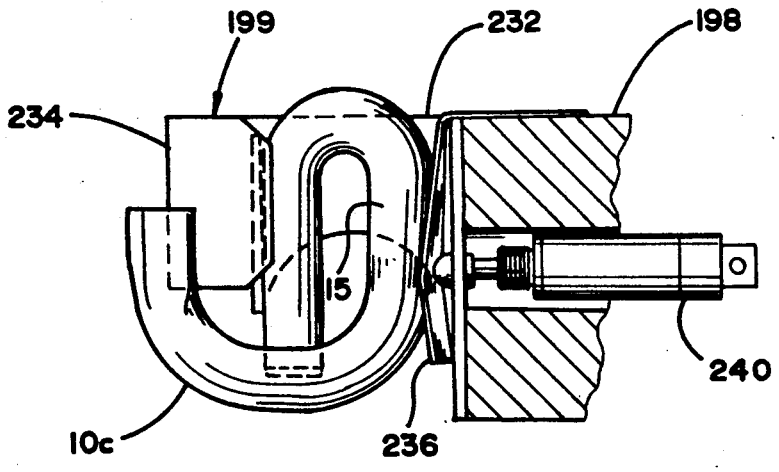
FIG. 18
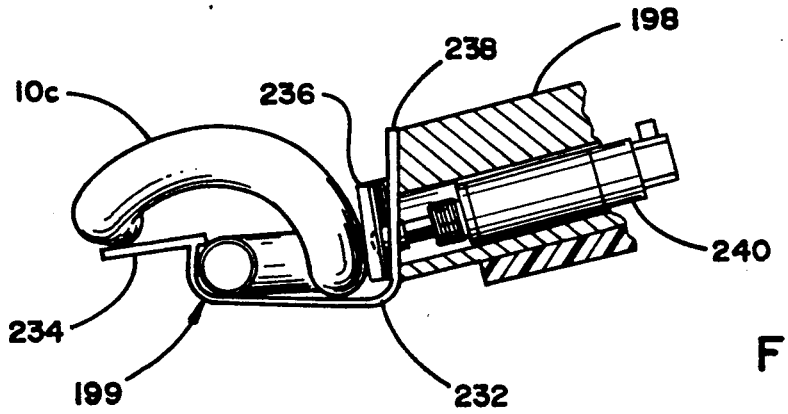
FIG. 19
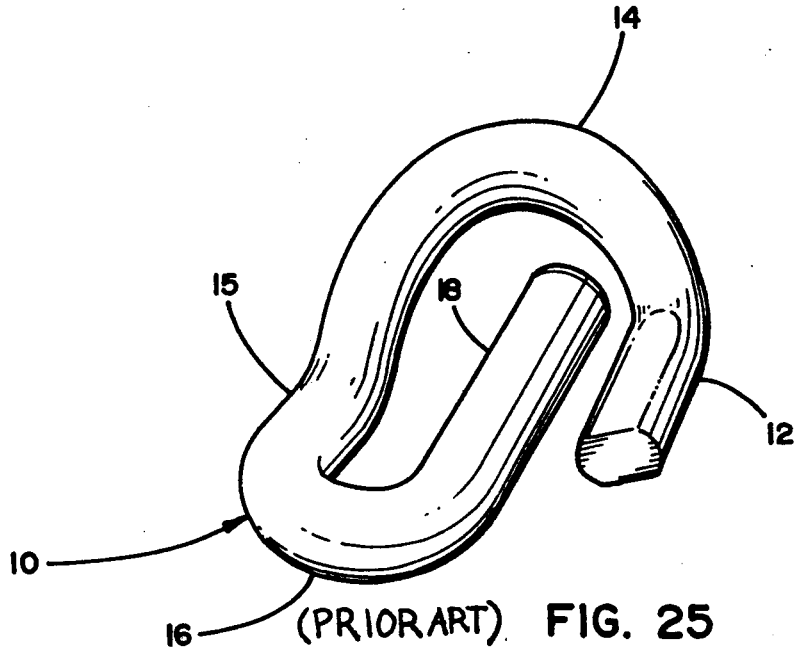
(PRIOR ART) FIG. 25

RAIL CLIP APPLICATOR AND METHOD OF APPLYING RAIL CLIPS

BACKGROUND OF THE INVENTION

1. Field of the Invention

The present invention relates to the laying and maintaining of railways, and, more particularly, to a machine for automatically installing clips for securing rails to ties.

2. Description of the Related Art

Railroad track is composed of rail sections laid parallel and spaced apart a uniform distance or gauge. The rails rest upon beams called ties or sleepers typically made of wood or concrete. The ties are spaced at regular intervals beneath the rails and are embedded in rock ballast to form a continuous supporting guideway upon which trains travel.

Track laying was originally accomplished entirely by hand labor using very large track gangs. This was dangerous and labor intensive work, and much of the evolution in track construction has concerned easing labor and improving safety. Today, track construction is accomplished almost entirely by mechanized art capable of laying track at a very rapid rate.

It is critical that the track be maintained in the correct geometry. The proper gauge is especially important, since gauges which are too wide or narrow may result in a rough ride, excessive wear, or even derailment. Thus, the durability of the attachment of the rails to the ties is highly important.

Much effort has gone into the study of the best means of restraining rails at their true geometry. The earliest means was to drive spikes into wood ties until the protruding head of the spike bears against the toe of the rail. Such spikes are still in use. Another type of spike is threaded and screwed into the wood tie. Such spikes are subject to loosening under the constant working of heavy wheel loads, and such loosening allows the track geometry to vary. Also, the development and growing use of concrete ties has led away from the use of spikes.

Because of the inherent disadvantages in spikes and the use of concrete ties, a trend has developed towards resilient fastening of the rail. One fastening device in current wide use is a steel bar bent into the form of a spring clip. One such clip is the PANDROL "e" clip sold by Pandrol Incorporated of Bridgeport, N.J. As shown in FIG. 25, this clip 10 is a generally cylindrical rod bent into a shape having a first free end portion forming a toe 12, an outwardly and upwardly arching front arch 14, a heel 15, a forwardly curving rear arch 16, and a second free end portion forming a center leg 18 disposed generally between the toe 12 and the heel 15.

Installed clips in use with concrete ties are shown in FIG. 26. The tie T is formed as an elongated block of concrete in which are embedded two pairs of cast iron or steel anchors one pair of which is shown at 20*a*, 20*b*. The lower extent of the rail R is formed with laterally extending rail toes 22. A rail pad 24 is disposed between the underside of the rail and the upper surface of the tie. Preferably, the pad 24 is made of a non-conductive elastomer to carry the bearing load from the rail to the tie and to prevent train control electrical signals from being shunted to earth through the somewhat conductive tie.

On either side of the rail, the upper extent of each anchor 20*a*, 20*b* is formed as a shoulder 26 protruding above the upper surface of the tie. Each shoulder is formed with a longitudinally extending hole 28 into which is inserted the center leg 18 of a clip. The heel 15 of each clip rests upon a ledge 29 formed on the outer extent of the shoulder. The toe 12 of each clip is disposed inwardly over a rail toe 22. An insulator 30 is disposed between the rail toe 22 and the clip toe 12. Each of the components is appropriately dimensioned such that the clip toe 12 bears down against the insulator 30 with a very heavy spring force sufficient to secure the rail in place.

The clips 10 may be used with other types of well known ties and anchors. For example, plates formed with upwardly arching shoulders may be attached by spikes to wood ties. The clips engage the shoulders in the same manner described above. The rail clip applicator of the present invention may also be used with a wide variety of such ties and anchors.

In the past, the clips 10 have been installed manually by placing the center leg 18 into alignment with the shoulder hole 28 and by pounding the clip into the shoulder. The clips have also been installed by a semi-automated method in which the clips are manually delivered, aligned, and started into the shoulders and are driven in by mechanical pincer devices. Such methods requires manual operations and are, therefore, relatively slow and labor intensive.

When the clips are pounded or driven into place in the shoulders, great care must be taken not to drive the clips too far. Referring to FIG. 24, a gap 32 should be maintained between the inner radius of the clip rear arch 16 and the adjacent vertical surface 34 of the shoulder 26. Preferably, the gap should be approximately $\frac{3}{8}$ inch. If this gap is not maintained, pounding or driving of the clip may damage or even shear off the shoulder. Also, the rear arch 16 may be deformed resulting in a stress rise which can cause fatigue and premature failure.

The clip described above has a nominal weight of 1.7 pounds. Four clips are applied at each tie, i.e., two per rail to tie attachment. A normal work day of present rail laying or tie replacement equipment can be at the rate of over 2,000 ties per day. This is equivalent to 8,000 clips, or seven tons of clips, at each worksite each day. The fully automated delivery and driving of this quantity of clips to precisely the correct positions in an economical, rapid and reliable manner is a heretofore unmet need.

SUMMARY OF THE INVENTION

The present invention satisfies the above-mentioned need by providing a fully automated, high volume clip applicator operable by only three persons. The applicator is a self propelled, two axle, self contained vehicle suitable for use in either new track construction or track maintenance tie replacement. The applicator is able to simultaneously and precisely deliver and position four clips at the four shoulders of a tie and drive the clips into place in the tie shoulders with the proper insertion force and distance.

The applicator includes means for loading and carrying a large quantity of clips. A boom with a basket or electromagnet loads clips into a conveyor which carries the clips upward into an overhead hopper. Two workers sitting atop the applicator load the clips from the hopper into the upper end openings of magazine extensions. The clips drop through the extensions into four magazines disposed on both sides of both rails. The magazines serially dispense the clips by pushing the bottom clip in the magazine into a clip-holding basket at the end of a shuttle arm. The shuttle arms receive the clips from the magazine and move the clips laterally toward the rails until the clip center legs are adjacent to and aligned with the shoulder holes. Backup blocks contact the rear of each shoulder while drive blocks drive the clips the proper distance from the baskets into the shoulder holes. Four clips are driven substantially simultaneously.

The applicator carries four applicator assemblies carried in back-to-back pairs, each applicator assembly disposed along one side of one rail, and each of which includes its own magazine, shuttle, backup block, and drive block. Each applicator assembly is independently longitudinally positionable with respect to the rail tie shoulder. The applicator assemblies each include a vertically movable head assembly carrying a backup block which is moved into position against the face of the shoulder opposite the shoulder hole opening into which the clip is to be inserted. When the backup block is so positioned, the shuttle arm, clip-holding basket, and drive block are thereby also precisely positioned for inserting the clip.

The applicator assemblies are carried in laterally spaced apart pairs on carrier frame assemblies. Each pair of applicator assemblies straddles one of the rails with web rollers bearing against the rail webs for accurate lateral positioning. The applicators assemblies are mounted to the carrier frame assemblies such that the applicators may be moved longitudinally forward and back with respect to the carrier frame assemblies a distance sufficient for the drive blocks to contact the shoulders. The carrier frame assemblies have wheels which roll atop the rails for support thereby.

The carrier frame assemblies are mounted to the applicator superstructure such the carrier frame assemblies may be lowered or raised in and out of engagement with the track. When raised, the applicator may be moved to and away from the work site.

Controls are provided to initiate and sequence the operations of the rail clip applicator on all four tie shoulders simultaneously. The controls also provide for applying clips along only one rail, or even on only one side of one rail.

The applicator of the present invention is able to achieve production rates of eight ties per minute or more with a crew of only three workers.

BRIEF DESCRIPTION OF THE DRAWINGS

FIG. 14 is a sectional view taken along the line XIV—XIV of FIG. 12;

FIG. 15 is a sectional view taken along the line XV—XV of FIG. 12;

FIG. 18 is a top view of the shuttle arm end carrying a clip with parts in section;

FIG. 19 is a side view of the shuttle arm end carrying a clip with parts in section;

FIG. 25 is a top perspective view of a rail spring clip of the type applied by the rail clip applicator of the invention;

FIG. 26 is a transverse sectional view through a track rail showing the securement of the rail to a tie by shoulders and clips;

DESCRIPTION OF THE PREFERRED EMBODIMENT

Figure 1:
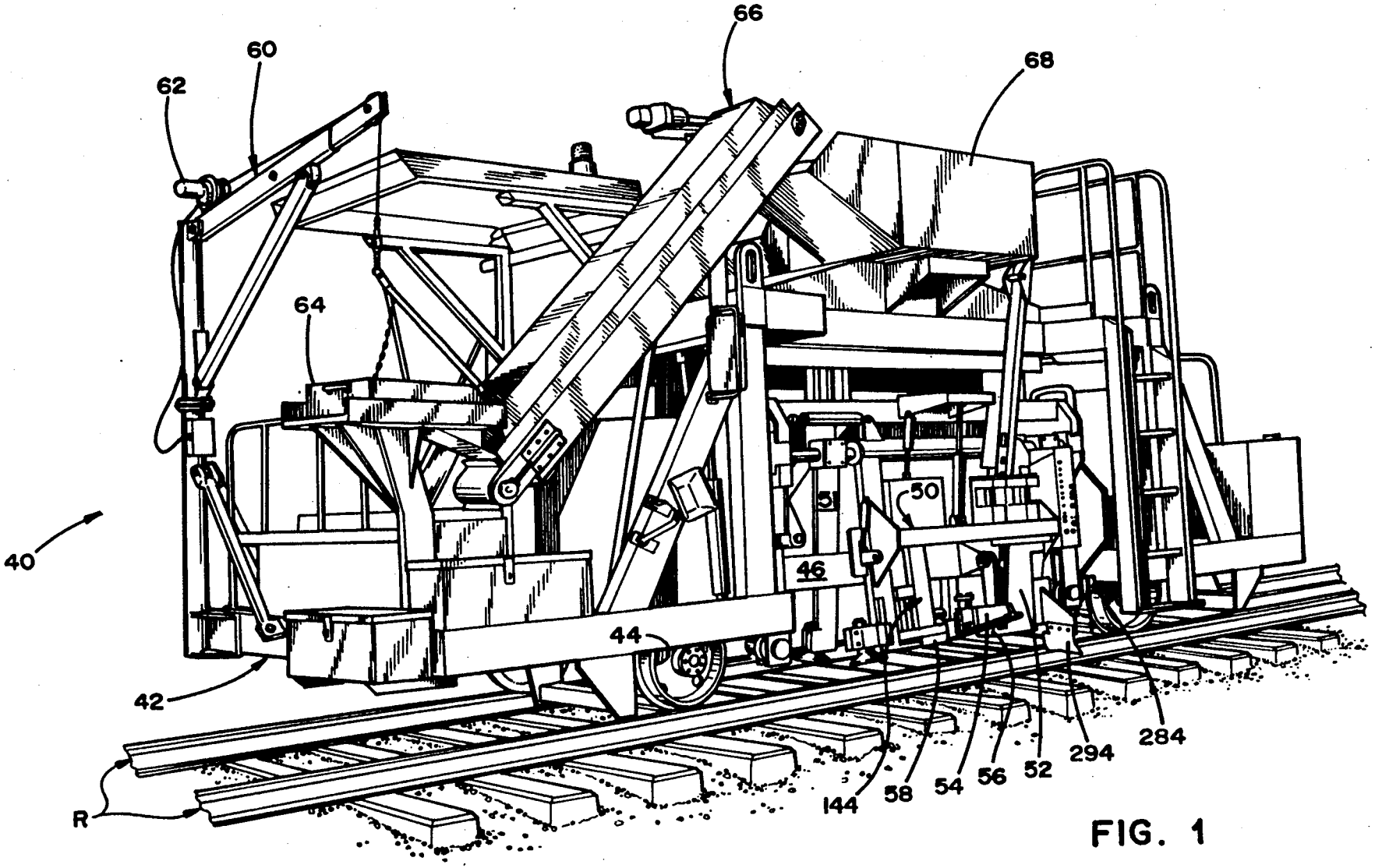
FIG. 1 is a rear and right side perspective view of the rail clip applicator according to the invention.
Figure 2:
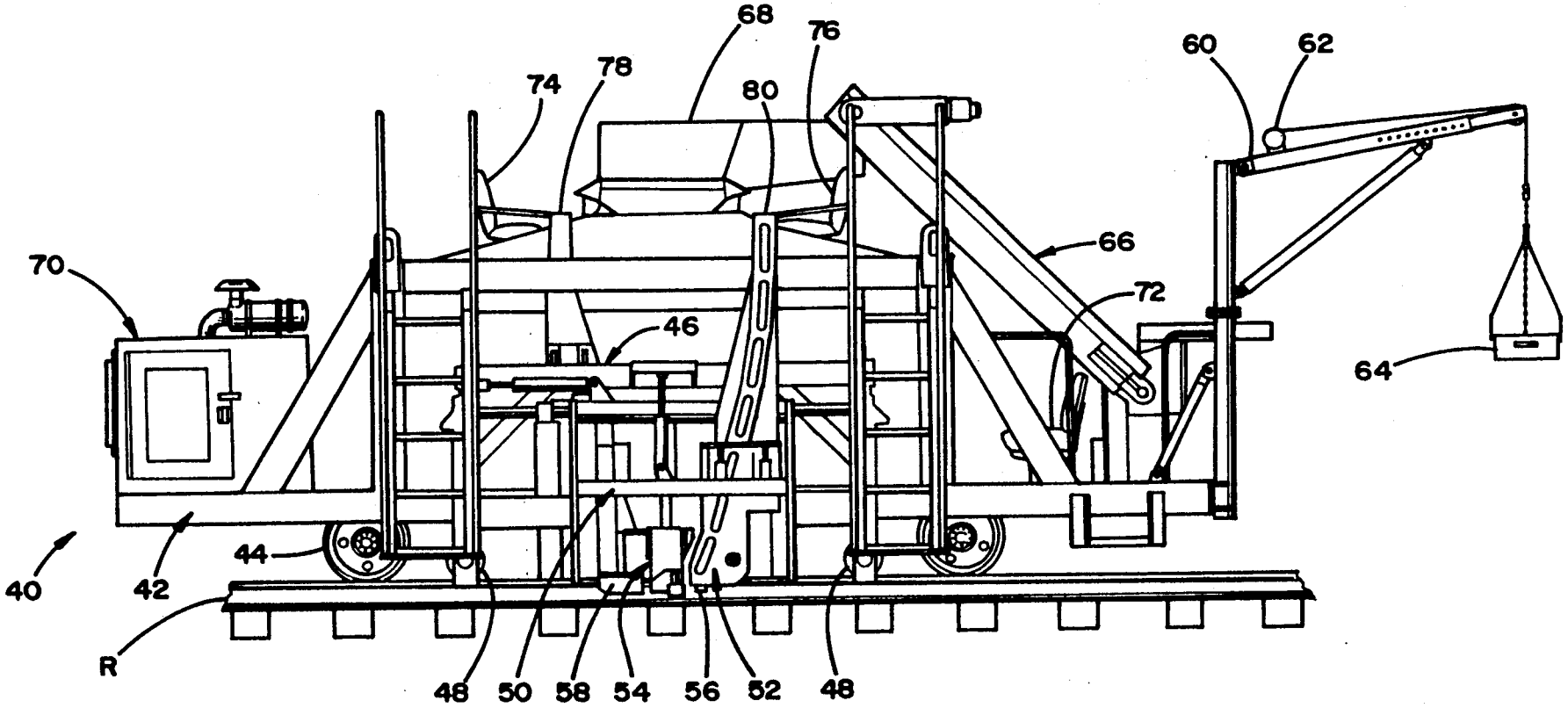
FIG. 2 is a somewhat diagrammatic left side view of the rail clip applicator.

By way of disclosing a preferred embodiment of the invention, and not by way of limitation, there is shown in FIGS. 1 and 2 a clip applicator 40 which includes in its general organization a generally longitudinally extending superstructure 42 supported on four conventional rail wheels 44 which roll atop rails R. Within the central extent of the superstructure on each lateral side thereof there is carried a carrier frame assembly 46 which may be raised during transport to and from the worksite, as in FIG. 1, or lowered onto the rail for clip installation, as in FIG. 2. When lowered, the carrier frame assemblies are supported on the rails by index wheels 48 (FIG. 2) which align the carrier frame assemblies longitudinally with the rails.

Each carrier frame assembly 46 carries an outer applicator assembly 50 and an inner applicator assembly 51 (FIG. 1). The inner and outer applicator assemblies are substantially identical and are carried back-to-back on the carrier frame assemblies with one applicator assembly rotated 180 degrees with respect to the other applicator assembly on the same carrier frame. Each applicator assembly includes a clip magazine 52, and a head assembly 144 carrying a clip shuttle 54, a drive block 56 and a backup block 58.

At the rear of the applicator there is a swinging boom 60 equipped with a powered winch 62. The boom is used to raise and lower a basket 64. The basket is lowered behind the applicator to be filled with clips carried by an adjacent tender car (not shown) which may be coupled to the applicator. The filled basket is raised and the clips are dumped in to the lower infeed end of an upwardly sloping conveyor 66. The clips are discharged from the upper end of the conveyor into a hopper 68 disposed across the central upper extent of the applicator. Preferably, the hopper is dimensioned to carry about 3,000 clips, although greater or lesser capacities are possible.

A diesel engine 70 is housed at the front of the applicator for providing power for propelling the applicator along the track, and for the hydraulic, electrical, and pneumatic systems of the applicator.

Figure 3:
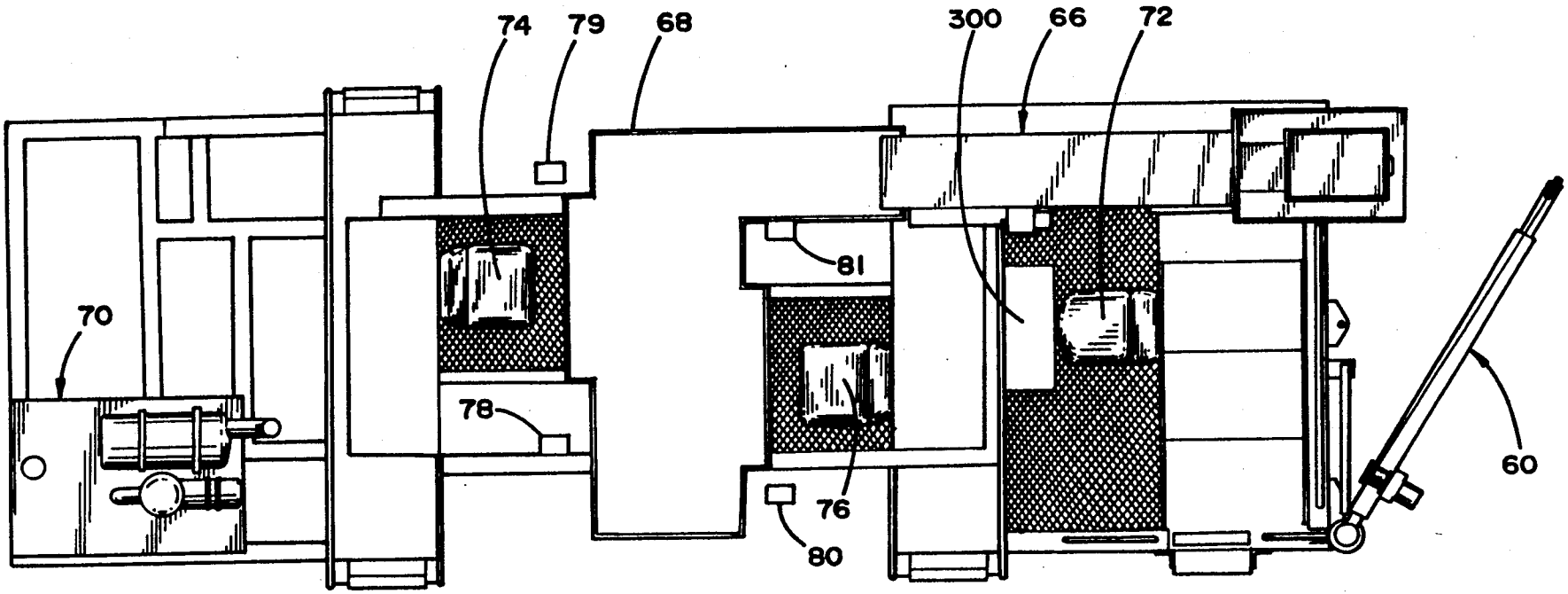
FIG. 3 is a somewhat diagrammatic top view of the rail clip applicator.

As best shown in FIGS. 2 and 3, at the rear of the applicator, there is a seat 72 for an operator who operates a control panel and supervises the main functions of the applicator. At the top of the applicator, there are seats 74, 76 disposed forwardly and rearwardly of the clip hopper 68. Seat 74 is for a first clip loader whose function is to pick clips from the hopper and insert them into the upper end openings of front left and right magazine extensions 78, 79. Seat 76 is for a second clip loader whose function is to pick clips from the hopper and insert them into the upper end openings of rear left and right magazine extensions 80, 81. Magazine extensions 79 and 81 deliver clips to the outer and inner sides respectively of the right rail, while magazine extensions 80, 78 deliver clips to the outer and inner sides of the left rail. At an operation rate of eight ties per minute, each clip loader will be dropping sixteen clips per minute into the magazine extensions.

Figure 4:
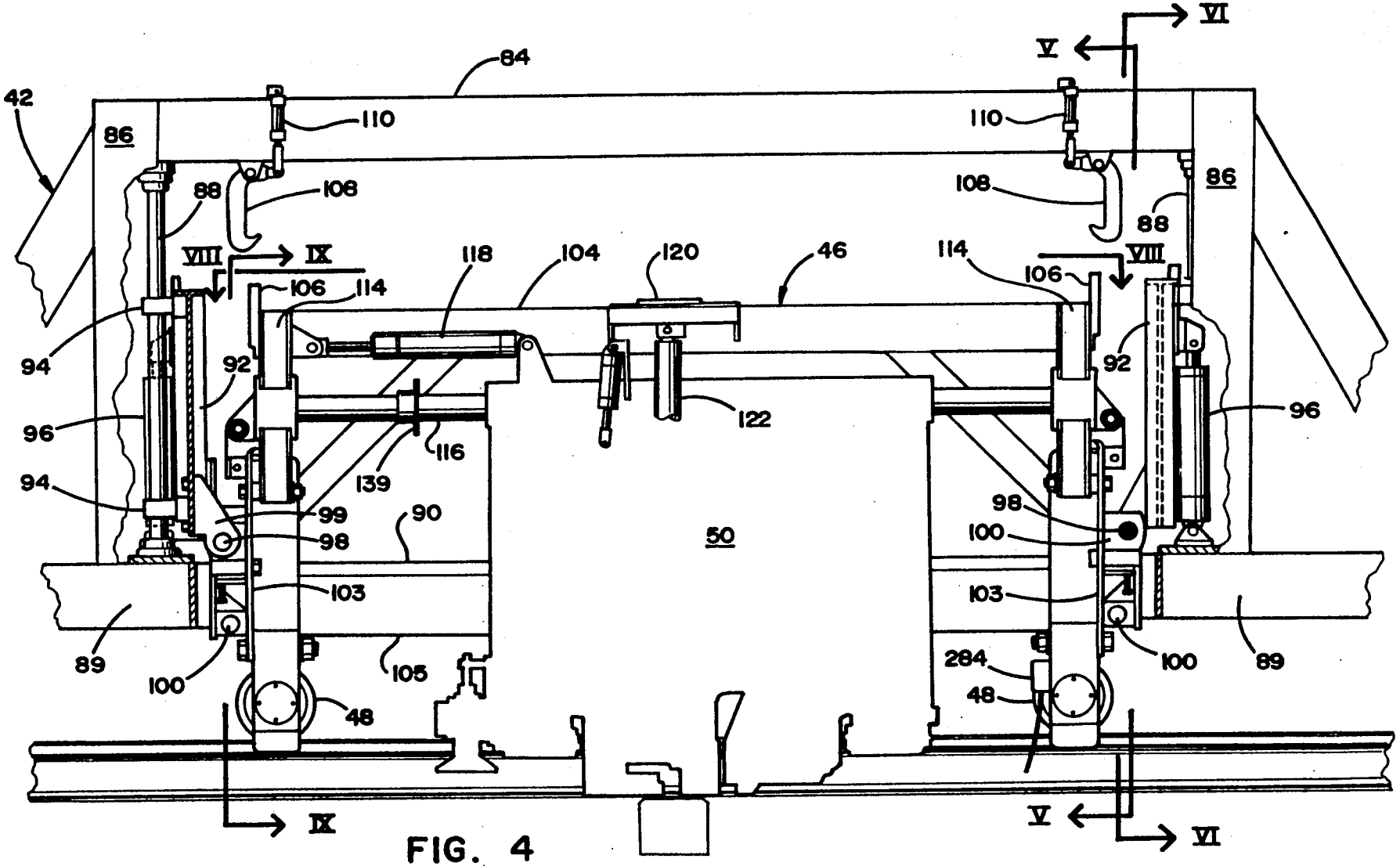
FIG. 4 is a fragmentary side elevational view of the central extent of the rail clip applicator with the outer applicator assembly shown only in outline, the inner applicator assembly not shown.
Figure 5:
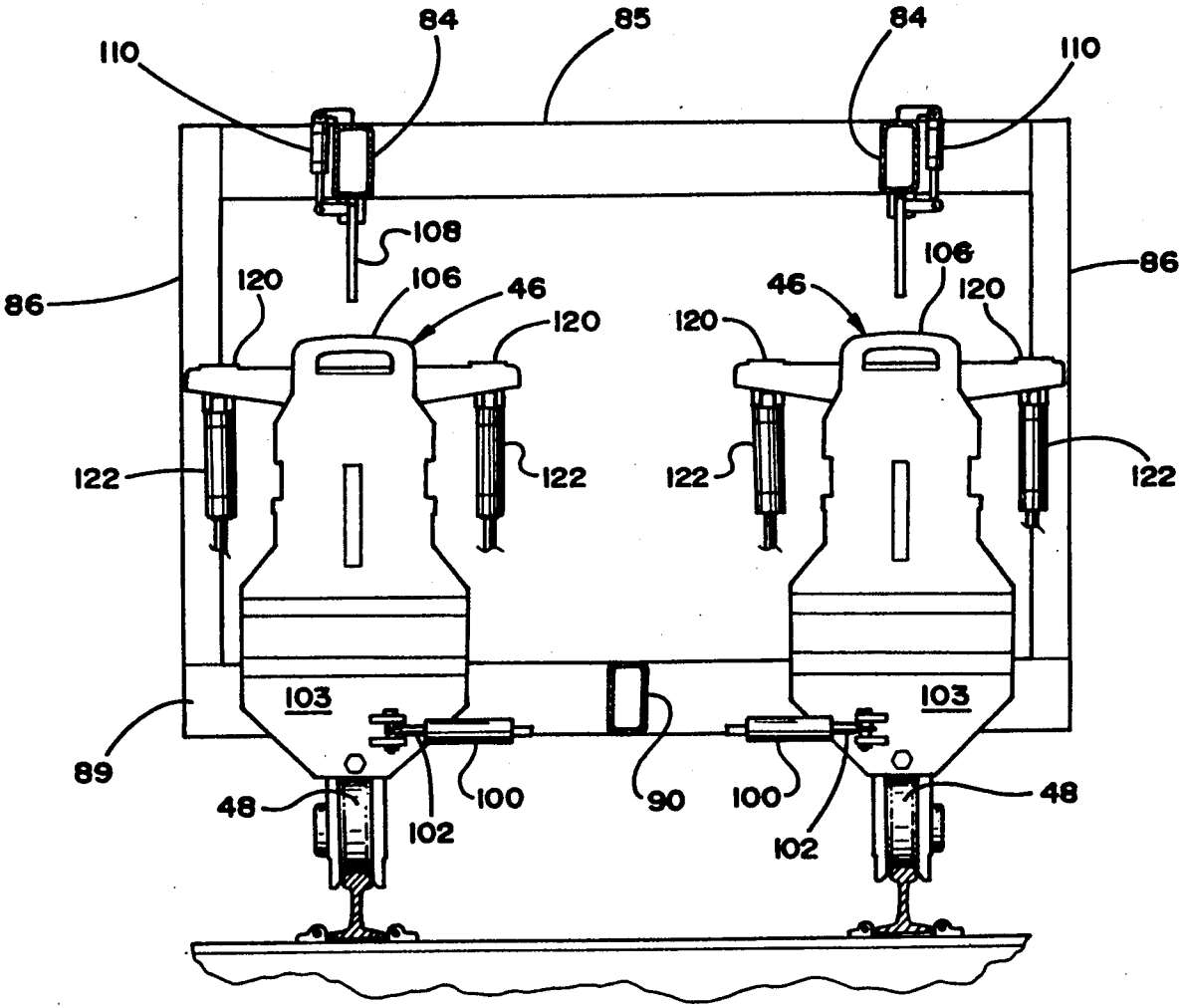
FIG. 5 is a sectional view taken substantially along the line V—V of FIG. 4.
Figure 6:
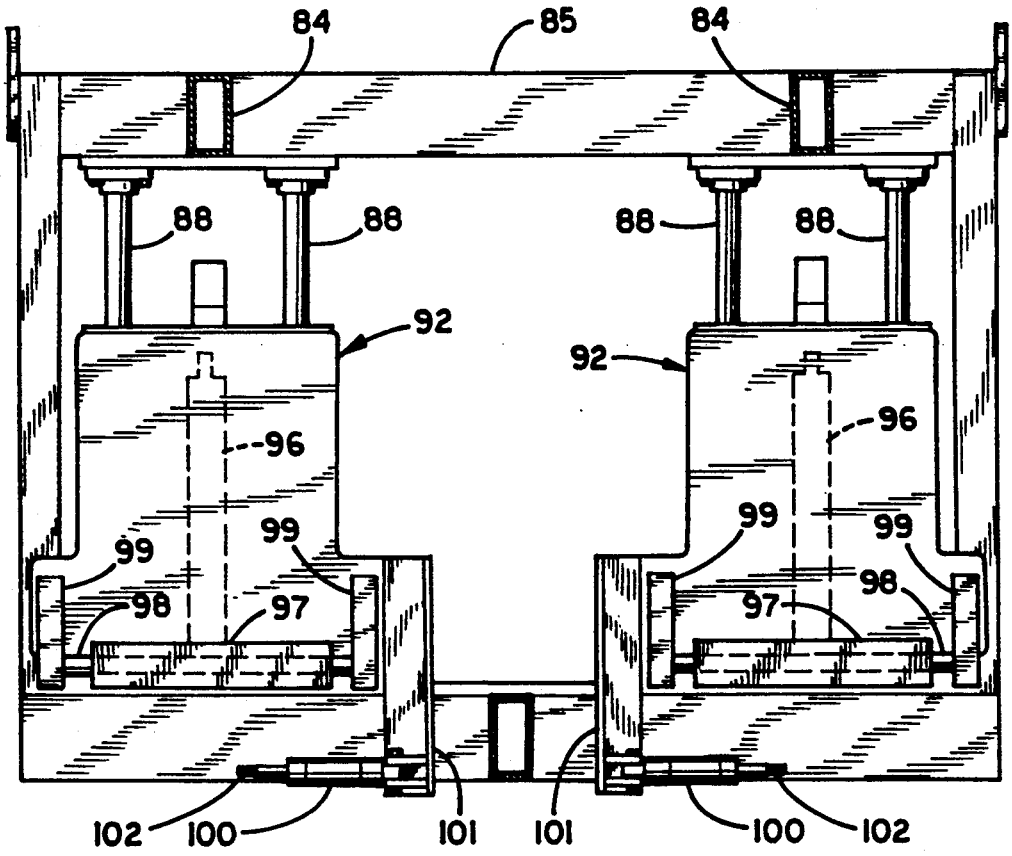
FIG. 6 is a sectional view taken substantially along the line VI—VI of FIG. 4.

The construction and mounting of the carrier frame assemblies 46 may be seen with further reference to FIGS. 4–6. The upper central extent of the superstructure 42 includes two parallel, spaced-apart, longitudinally extending beams 84 extending between crossbeams 85. The crossbeams extend laterally between pairs of end upright beams 86. Adjacent each end of the each carrier frame assembly there are a pair of vertical guide rods 88 extending between a cross beam 85 and a lower member 89 of the superstructure. A lower longitudinal beam 90 spans the lower members 89 between the carrier frame assemblies 46.

At each end of each carrier frame assembly there is a carrier lift assembly 92 which rides upon bearing blocks 94 up and down on guide rods 88 driven by hydraulic cylinders 96 disposed between the guide rods 88. A horizontal guide rod 98 spans between lugs 99 disposed toward the center of the clip applicator. At each end of each carrier frame assembly there is a guide trunion 97 which allows the carrier frame assembly to slide laterally. A laterally disposed hydraulic cylinder 100 is provided at each end having a first end affixed to a downward extension 101 of the carrier lift assembly 92 and a second end 102 affixed to an end plate 103 (FIG. 4) of the carrier frame assembly. Activation of cylinders 100 causes the carrier frame assemblies to move laterally in and out for adjustment to the track gauge.

The carrier frame assemblies 46 each include an upper longitudinal beam 104 having its ends disposed spaced centrally apart from the carrier lift assemblies 92. A lower longitudinal beam 105 extends between the ends of the carrier frame assemblies. At each end of the beam 104 there is an inverted U-shaped lug 106. When the carrier frame assemblies are lifted into their transport position (as in FIG. 1), the lugs 106 are engaged by hooks 108. The hooks 108 are rotated in and out of latching position by air cylinders 110.

Figure 27:
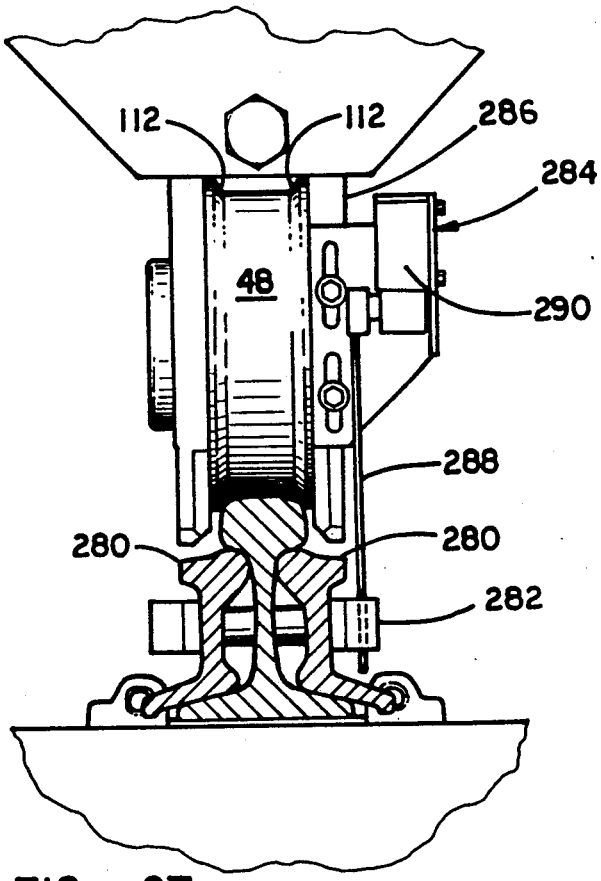
FIG. 27 is an end view of a rail adjacent a rail joint having tie bars and the tie bar sensor.

At the lower extent of each end of the carrier frame assemblies there is journaled an index wheel 48. Referring briefly to FIG. 27, it may be seen that the index wheels are provided with a pair of opposed peripheral flanges 112 that are spaced to closely conform to the width of the rail head. The index wheels thus serve to position and guide the carrier frame assemblies in longitudinal alignment with the rails.

Extending longitudinally between end upright members 114 of each carrier frame assembly there is provided a pair of laterally spaced apart cylindrical carrier shafts 116. The carrier shafts serve to support the applicator assembly 50 for longitudinal movement therealong. A hydraulic cylinder 118 is provided on either lateral side of each carrier frame assembly interengaging an end of the carrier frame assembly and the applicator assembly 50. As described more fully below, cylinders 118 are activated to position the applicator assemblies longitudinally with respect to each tie shoulder.

Wings 120 extend laterally to either side of the upper beam 104 of each carrier frame assembly. Hydraulic cylinders 122 have their upper ends affixed to the wings for swinging the applicator assemblies in and out as described more fully below.

Figure 7:
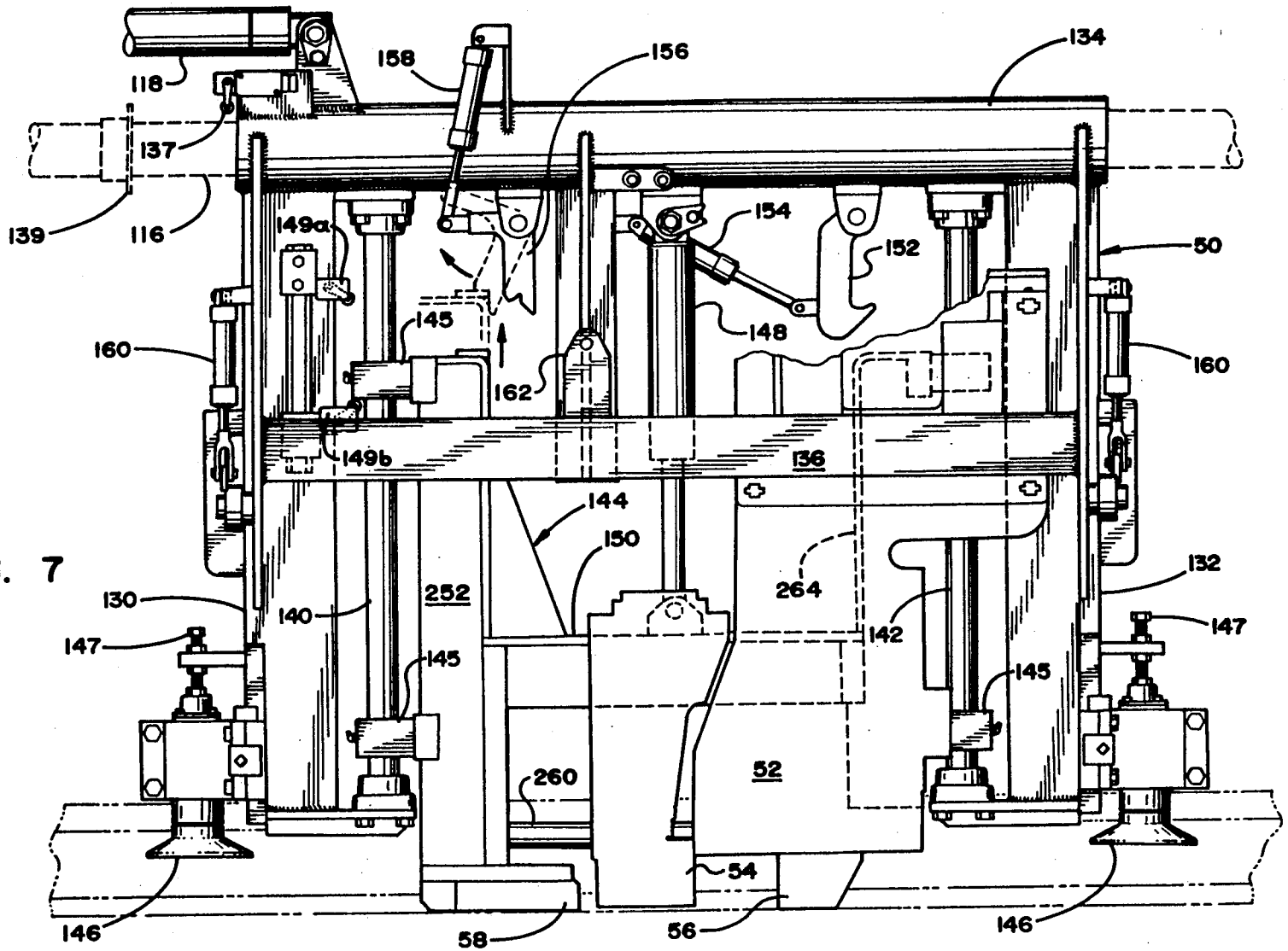
FIG. 7 is a side elevational view of the applicator assembly indicated in outline in FIG. 4.
Figure 8:
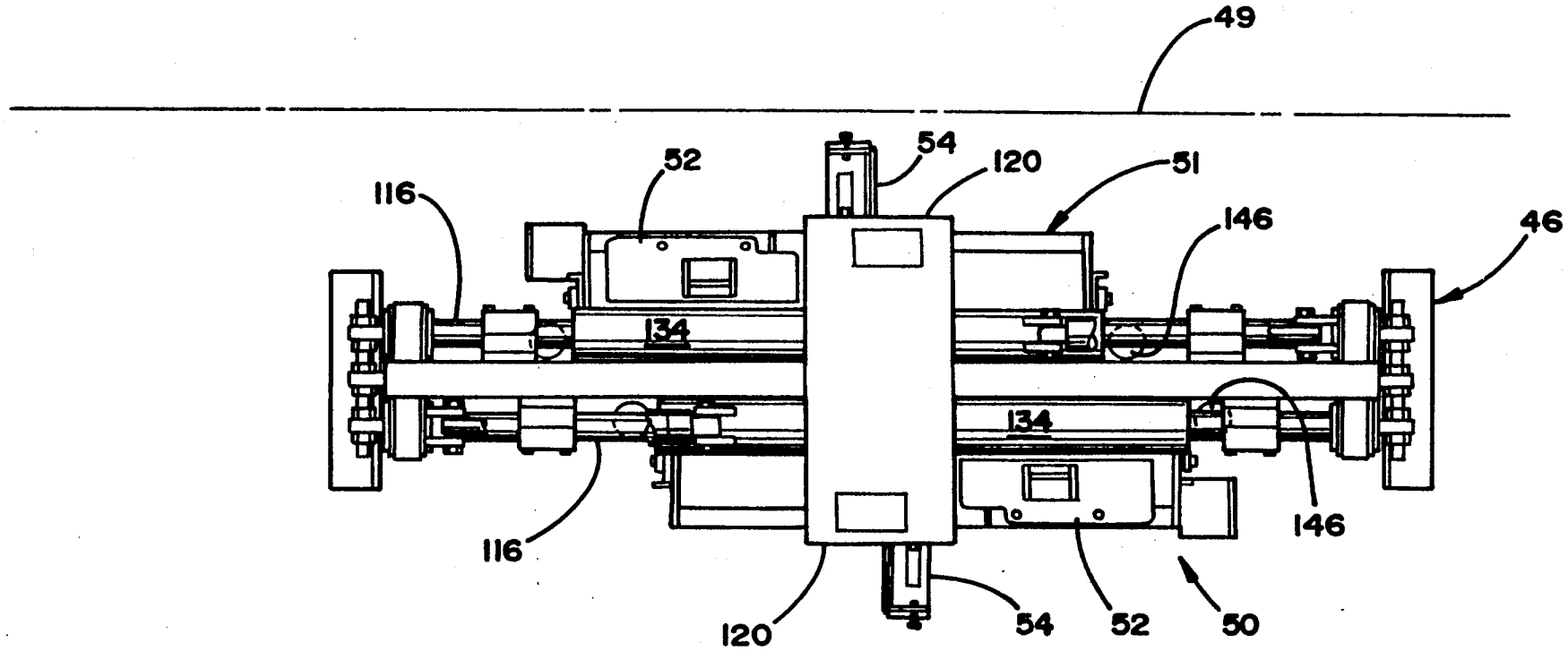
FIG. 8 is a plan view taken substantially along the line VIII—VIII of FIG. 4.
Figure 9:
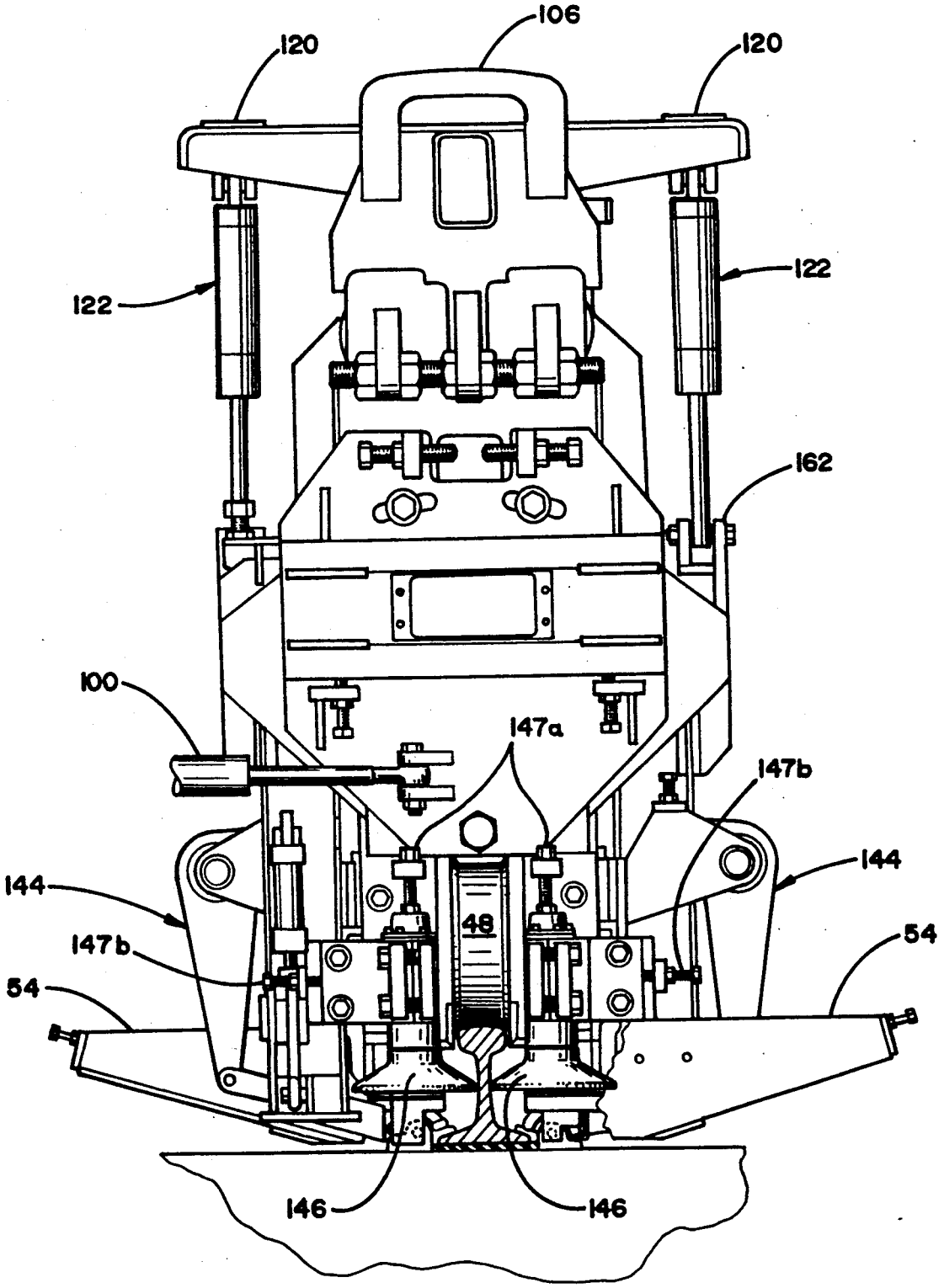
FIG. 9 is an end view taken substantially along the line IX—IX of FIG. 4.

Details of the applicator assembly 50 may be seen in FIGS. 7–9. It is to be understood that the clip applicator includes four applicator assemblies carried in pairs on each of the two carrier frame assemblies 46. Thus, as shown in FIG. 8, one carrier frame assembly 46 carries identical but reversed applicator assemblies 50, 51 on the two carrier shafts 116, while a second carrier frame assembly (not shown) on the opposite side of the clip applicator center line 49 carries a second pair of applicator assemblies. Thus, clips on either side of a track rail are driven into the shoulders in opposite directions.

The applicator assembly includes a frame having longitudinally spaced apart upright members 130, 132, a cylindrical linear bearing member 134 which slides along a carrier shaft 116 driven by cylinder 118, and an intermediate longitudinal cross member 136 spanning between the uprights 130, 132. A limit switch 137 is affixed to one end of the bearing member 134 to sense and limit the distance of longitudinal travel of the applicator assembly by contact with a collar 139 affixed to the carrier shaft 116 (see also FIG. 4). Air cylinders 160 are provided on the uprights 130, 132 for moving latch elements 164 (FIG. 10*a*) described more fully below in connection with the lateral swinging of the applicator assembly 50. The clip magazine 52 is affixed to the cross member 136; the magazine therefore moves in conjunction with the applicator assembly.

At the lower end of each of the uprights 130, 132 there is provided a web guide roller 146 mounted for rotation about a generally vertical axis. As shown in FIG. 9, when the applicator assemblies 50 are in the operating position, web guide rollers disposed on either side of the rail bear against the vertical web of the rail to position the applicator assemblies laterally with respect to the rail. The vertical and lateral position of the web guide rollers may be adjusted by means of screws 147*a*, 147*b*.

Extending generally vertically disposed longitudinally centrally of the uprights 130, 132 are guide rods 140, 142. Disposed between the guide rods 140, 142 there is a head assembly 144 mounted for vertical sliding along the guide rods by four bearing blocks 145. Limit switches 149*a*, 149*b* are mounted alongside the upper extent of the guide rod 140 to detect and signal the limits of vertical movement of the head assembly 144.

The head assembly, as described more fully below, includes the backup block 58, the clip shuttle 54, and the drive block 56. The head assembly is movable up and down on the applicator assembly along guide rods 140, 142 driven by the action of hydraulic cylinder 148. Hydraulic cylinder 148 has its ends affixed to the bearing member 134 and to a cross member 150 of the head assembly.

Hook 152, rotated by air cylinder 154, is provided to engage a slot formed in the head assembly to hold the head assembly in a transport position. Upstop 156 is linked to air cylinder 158 to sense and limit the vertical motion of the head assembly during its operating cycle.

Figure 10C:
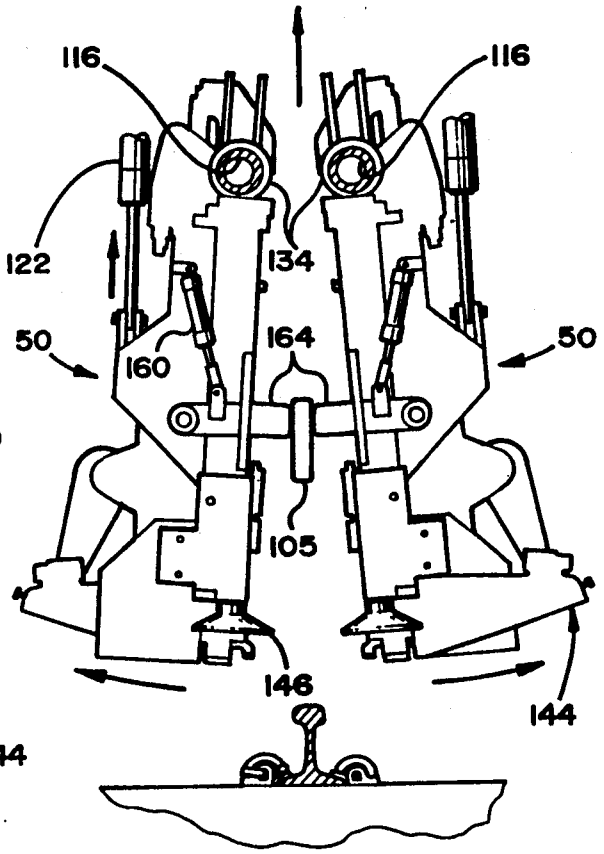
FIGS. 10*a*, 10*b*, and 10*c* are diagrammatic end views of the applicator assemblies of one side of the clip applicator shown in the clip inserting position, the advancing position, and the transport position, respectively.
Figure 10B:
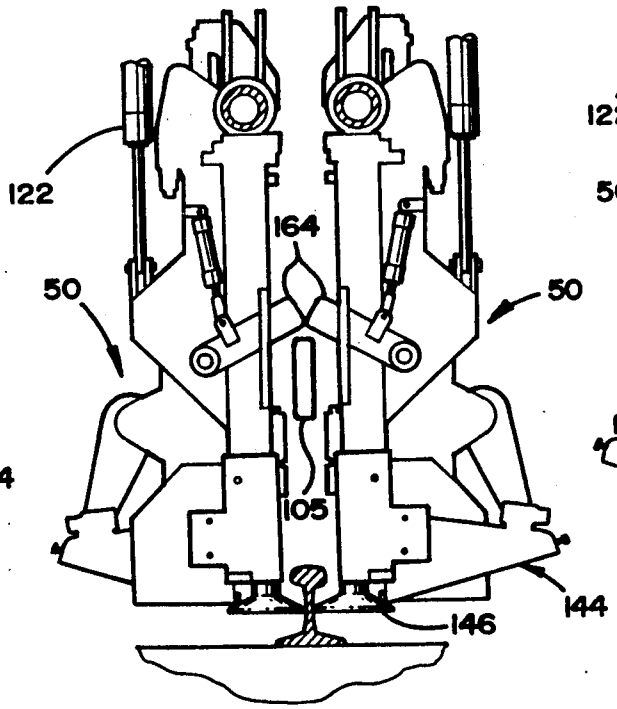
Figure 10A:
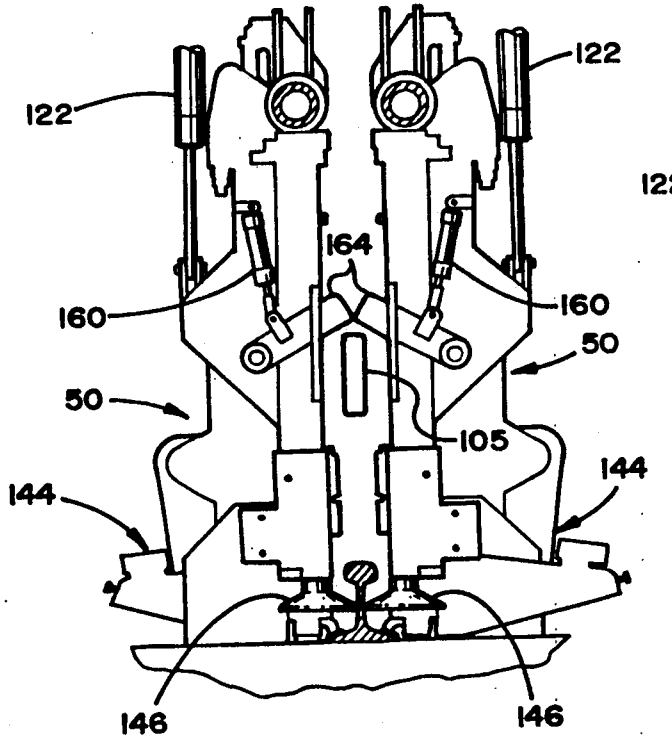

The three positions of the applicator assemblies 50 are shown in FIGS. 10*a*–10*c*. In FIG. 10*a* and FIG. 9, the applicator assemblies are in the operating position in which the web guide rollers 146 are in contact with the rail web and the head assemblies 144 are lowered into position for rail clips to be inserted into the shoulders. The applicator assemblies 50 are maintained in this position by the force of hydraulic cylinders 122. The upper ends of cylinders 122 are affixed to the wings 120 and the lower ends are affixed to lugs 162 on the applicator assembly cross members 136. The air cylinders 160 are retracted so as to raise the latches 164.

In FIG. 10*b*, the applicator assemblies are in position for advancing the clip applicator to the next tie. This position is similar to the position of FIG. 10*a* except that the head assemblies 144 have been raised by the action of cylinders 148 (FIG. 7).

In FIG. 10*c*, the applicator assemblies are swung apart from each other and the rail by the retraction of cylinders 122. This rotation occurs along the common axes of the carrier shafts 116 and the linear bearing members 134. When swung out, the air cylinders 160 are extended to lower the latches 164 such that the latches contact the longitudinal beam 105 of the carrier frame assembly 46 to lock the applicator assemblies in a spread apart position. The carrier frame assembly is lifted by cylinders 96 (FIG. 4) and locked by hooks 108 so that the head assemblies and other components are clear of the rails for transporting the clip applicator to and from work sites.

Figure 11:
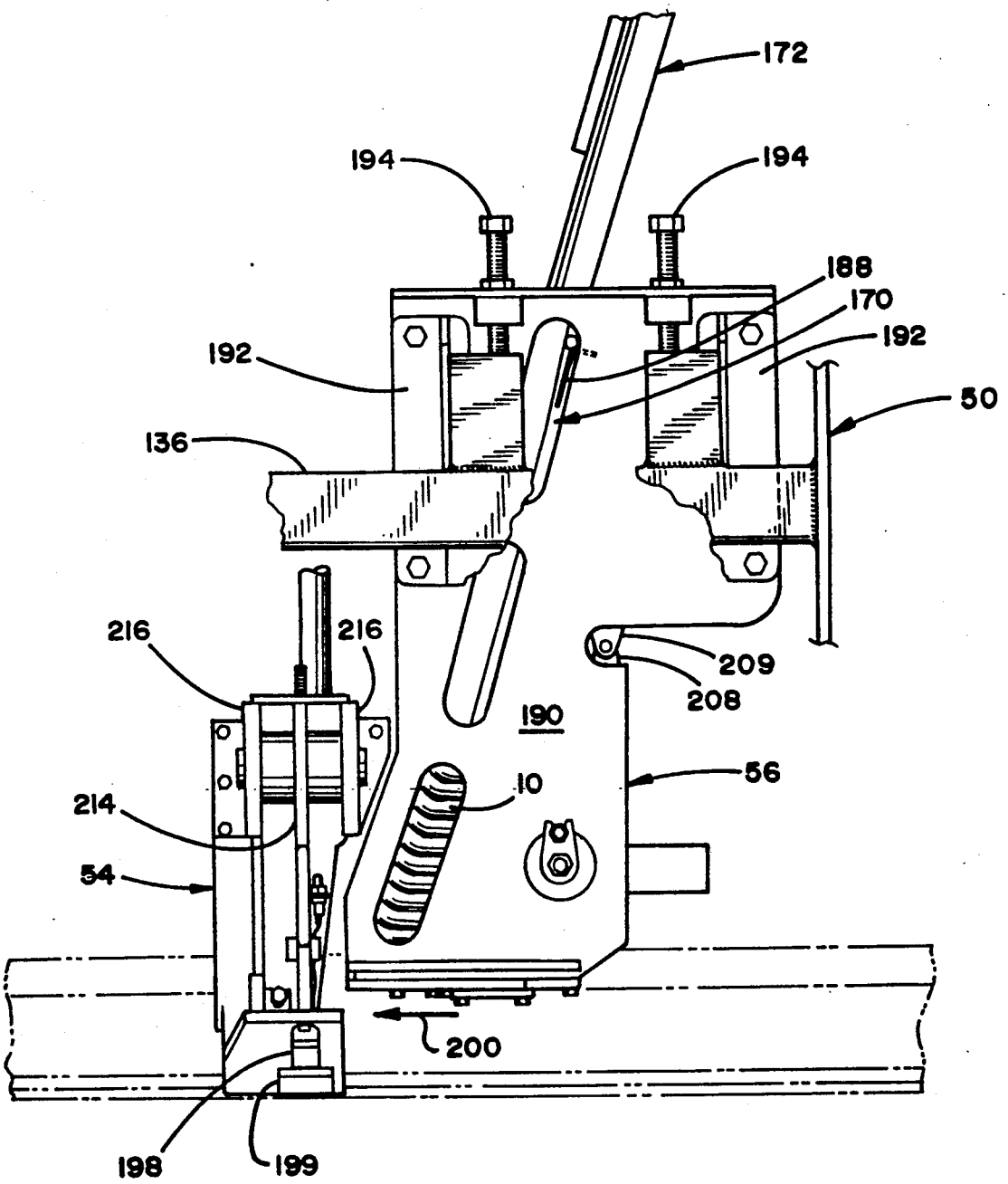
FIG. 11 is a side view of the clip magazine and the clip shuttle.
Figure 12:
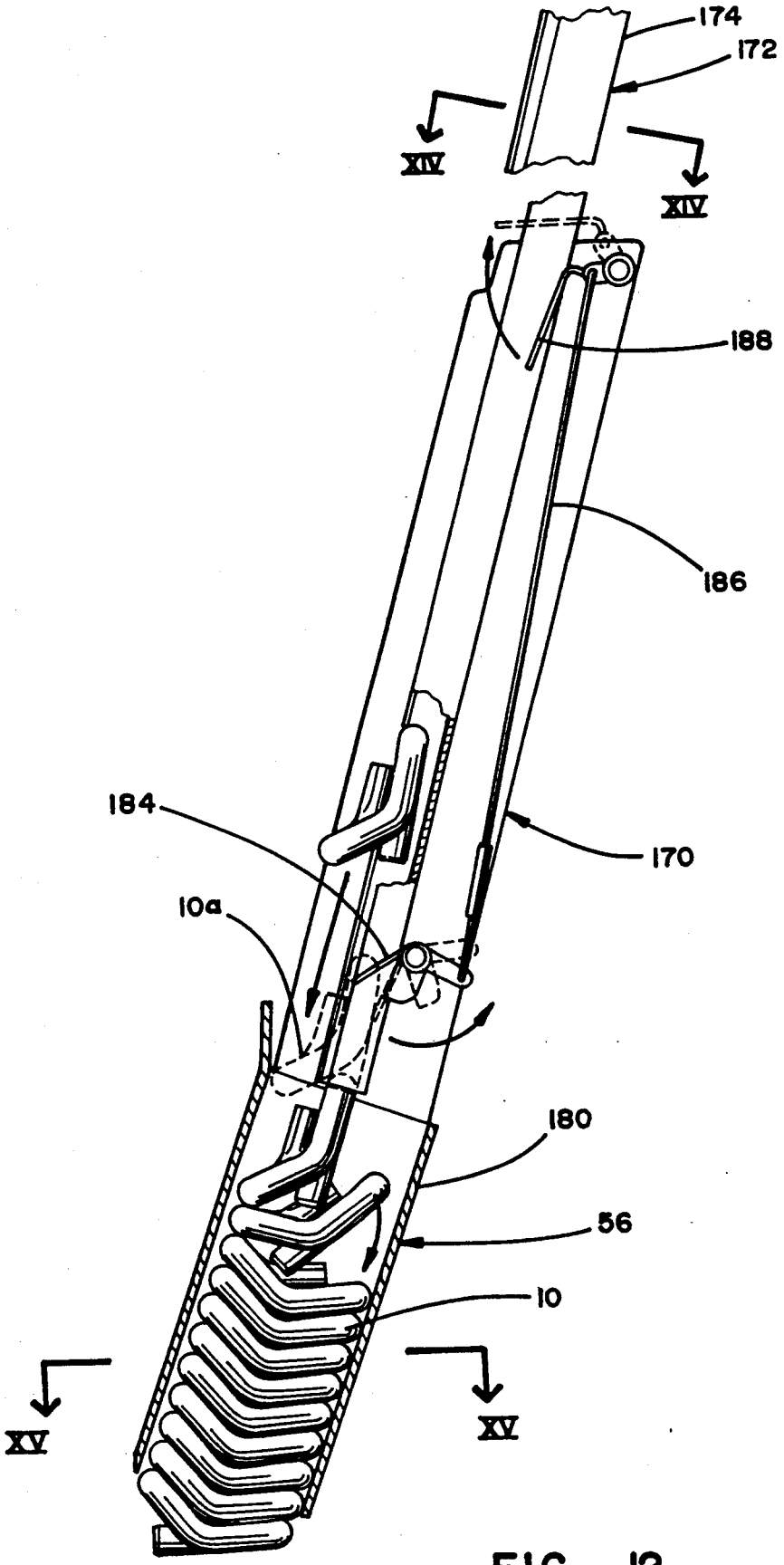
FIG. 12 is a side view of the clip path within the clip magazine and the clip magazine extension.

Details of the clip magazine may be seen in FIGS. 11–15. As shown in FIG. 12 the clips 10 are loaded into the magazine 56 through a generally vertical, slightly sloping passageway defined by a lower magazine extension 170 and an upper magazine extension 172. The upper end opening 174 of upper magazine extension 172 corresponds to any of the upper magazine extensions 78–81 as shown in FIG. 3.

As shown in FIG. 14, the passageway of the upper magazine extension 172, as well as the lower magazine extension 170, is formed by a generally C-shaped elongated member. An inner wall 176 protrudes into the passageway with a formed lip 175. The upper opening of the upper magazine extension is thus formed so that it is impossible to load clips in any orientation other than the correct orientation. The correct orientation is with the front arch 14 inserted first and the toe 18 under the lip 175.

Proper operation of the magazine 56 requires that there be a sufficient number of clips 10 in the magazine to orient the clips properly, but not so many clips that clips jam or stick. As shown in FIG. 12, the clip magazine 56 includes a stacking nest 180 dimensioned to store nine or ten nested clips. As clips fall from the lower magazine extension 170 into the stacking nest 56 their inertia and center of gravity cause them to rotate into the correct nested position. As shown in FIG. 15, an inner wall 182 may be provided in the stacking nest 180 to orient the clips 10 correctly. In a manner described below, clips are ejected from the magazine in the direction indicated by arrow 183.

As shown in FIG. 12, a mechanism is provided to give the clip loader sitting atop the clip applicator an indication of whether the clip magazine is full. A pivoting lever is mounted near the bottom of the lower magazine extension 170. The lever is linked by rod 186 to pivoting flag mounted near the top of the lower magazine extension. When the magazine is not full of clips, the weight of the flag and rod push the lever 184 so that the lever protrudes into the clip passageway near the bottom of the lower magazine extension and so that the flag 188 is down. When the magazine is full of clips, the uppermost clip 10*a* will bear on the lever and force the rod 170 upward. This also causes the flag 188 to swing upward, thus giving a visual indication to the clip loader that the magazine is full. After sufficient clips have been ejected from the magazine, the flag will again pivot down, signalling the clip loader that more clips should be loaded into the upper magazine extension.

As shown in FIG. 11, the magazine 56 includes a cover plate 190 mounted to the cross member 136 of the applicator assembly 50 by means of bolting to brackets 192. The position of the magazine may be adjusted by means of adjustment screws 194. The clip shuttle 54 is shown in its lowered position in readiness for a clip carried at the end of the shuttle arm 198 in a clip basket 199. For loading of a clip into the shuttle arm clip basket, the clip shuttle is raised and the bottommost clip in the magazine is ejected in the direction indicated by arrow 200 generally parallel to the track. The motion of the shuttle arm 198 is generally perpendicular to the track.

Figure 13A:
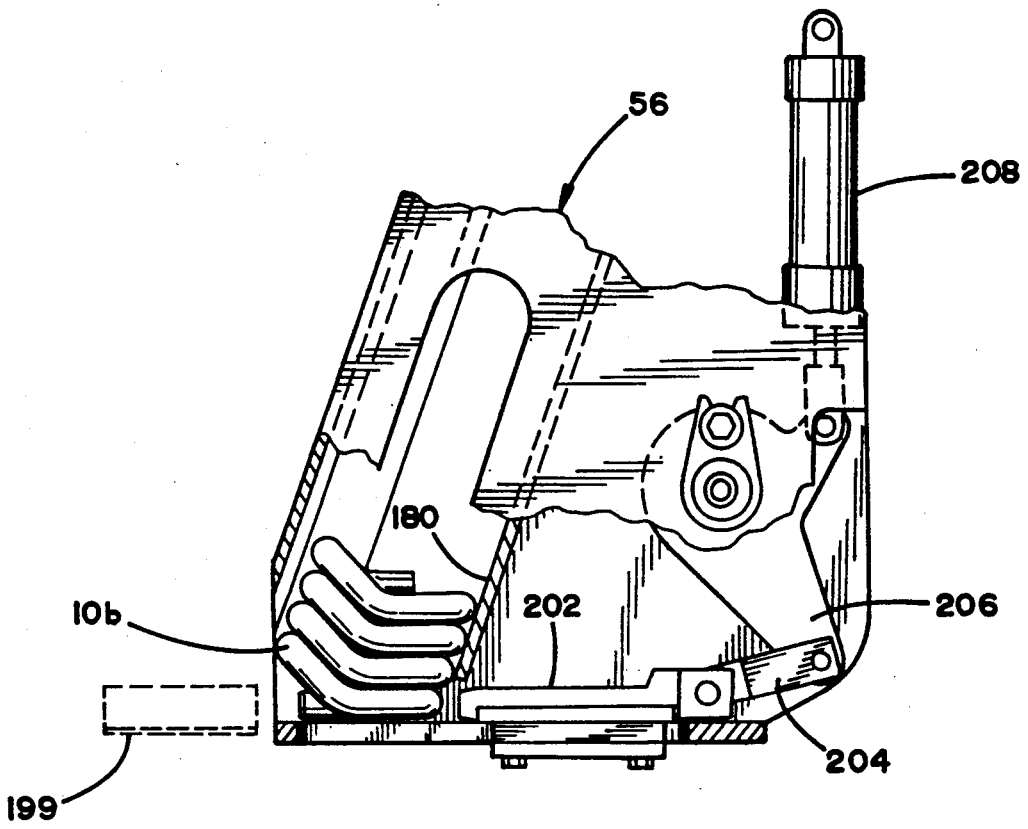
FIGS. 13*a* and 13*b* are side views of the clip magazine with parts broken away illustrating the operation of the clip pusher.
Figure 13B:
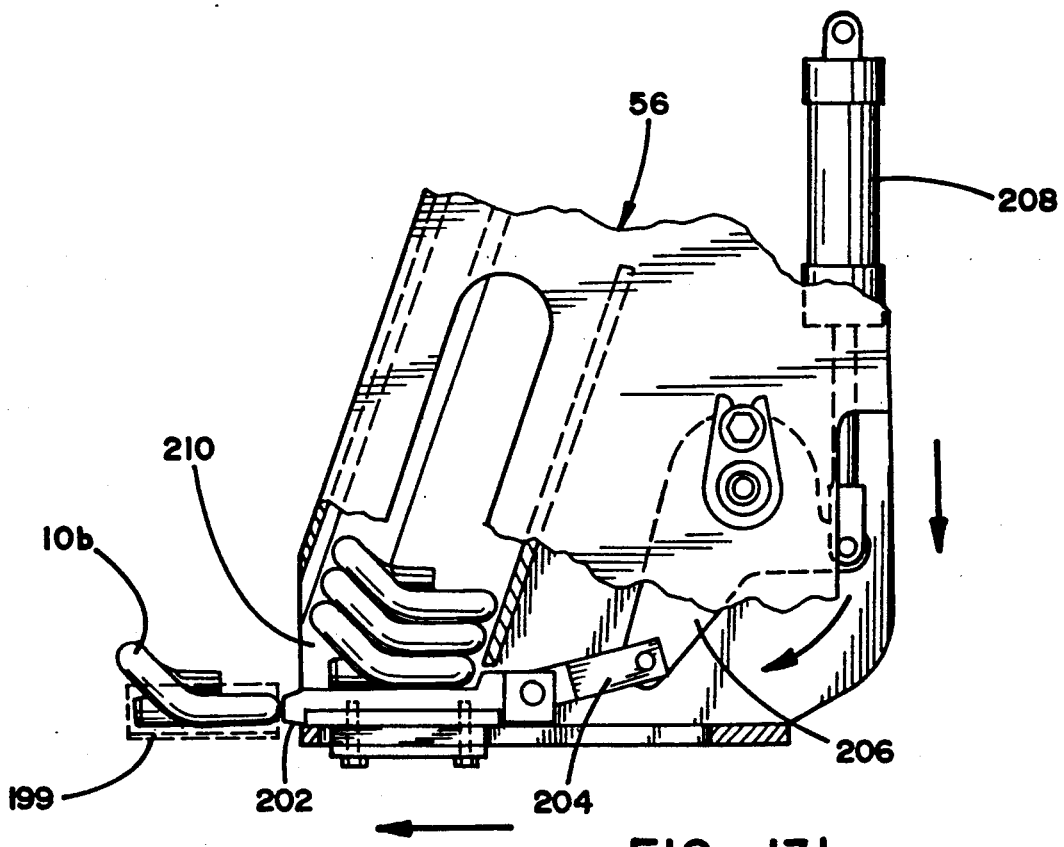

FIGS. 13*a* and 13*b* show details of the magazine mechanism for ejecting clips into the shuttle arm clip basket. In FIG. 13*a*, the bottommost clip 10*b* in the stacking nest 180 is positioned in readiness for being ejected by pusher body 202 into the shuttle arm clip basket 199. Pusher body 202 is connected by link 204 to one end of crank arm 206. The other end of crank arm 206 is connected to the lower end of hydraulic cylinder 208. The upper end of cylinder 208 is connected to lug 209 (FIG. 11). Activation of cylinder 208 rotates crank arm 206 moving the connecting link 204 and the pusher body 202 toward the bottommost clip 10*b*. As shown in FIG. 13*b*, the clip 10*b* is pushed through the opening 210 at the bottom of the magazine into the clip basket 199. When another clip is needed in the clip basket, the cylinder 208 then retracts to withdraw the pusher body 202 back to the position of FIG. 13*a* allowing the stack of clips in the stacking nest to drop so that the next clip is positioned in readiness for being pushed out to the basket.

Details of the clip shuttle 54 may be seen in FIGS. 16–19. Shuttle arm 198 is mounted to slide toward and away from the track rail R along lower plate 210 as indicated by arrow 211. The rear end of the shuttle arm is linked by adjustable eye bolt 212 to the lower end of crank arm 214. Crank arm 214 is mounted for rotation to clevis lugs 216 (see also FIG. 11) affixed to the upper end of upright member 218. Air cylinder 220 has its upper end attached to the upper end of crank arm 214 and its lower end attached to the lower extent of member 218. Activation of cylinder 220 causes extension and retraction of the shuttle arm 198. Adjustment screws 222 and 224 are provided for limiting the travel of the shuttle arm. Limit switch 226 is provided to detect and signal the full retraction of the shuttle arm. Limit switch 227 is provided to detect and signal the full extension of the shuttle arm. Handle 228 is provide for manually moving the crank arm 214 in the event of a malfunction.

The clip shuttle 54 is affixed by upright member 218 to the cross member 150 (FIG. 7) of the head assembly and moves in fixed relationship with the head assembly.

Figure 16:
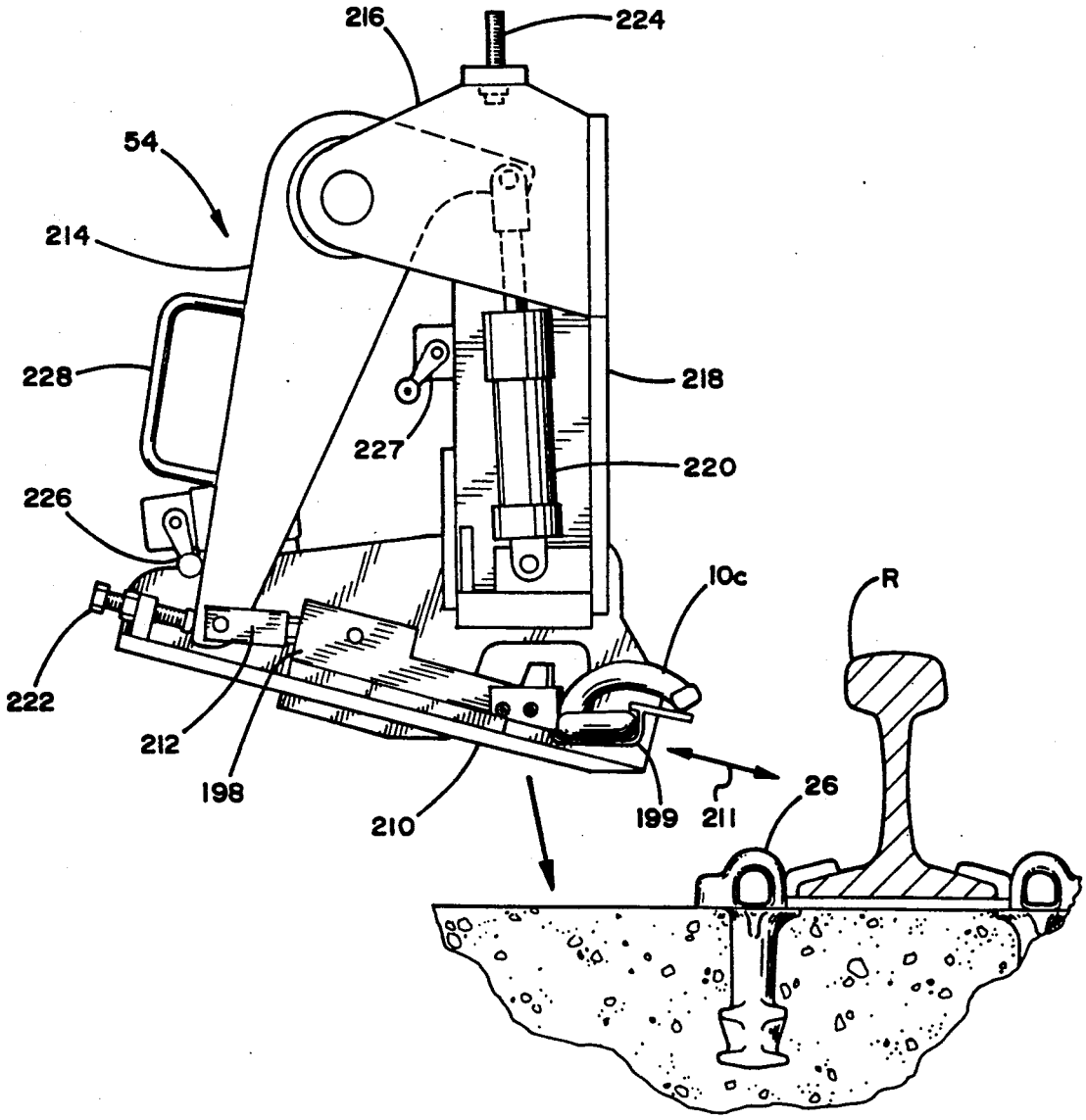
FIG. 16 is a side elevational view of the clip shuttle 54 in the up position.
Figure 17:
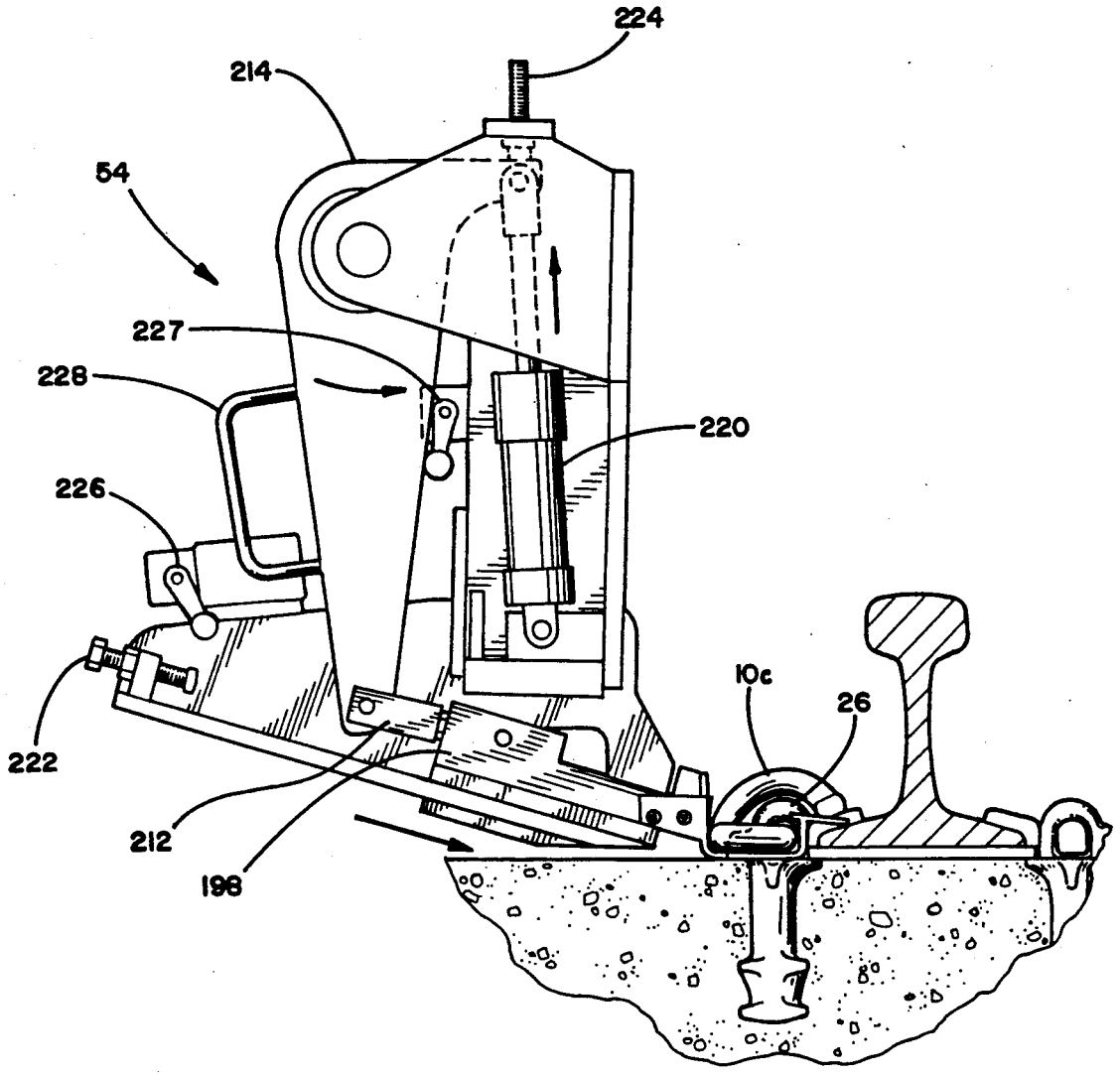
FIG. 17 is a side elevational view of the clip shuttle 54 in the down and extended position.

FIG. 16 shows the clip shuttle in its raised operating position in which a clip 10*c* has been loaded from the clip magazine into the clip basket 199. FIG. 17 shows the clip shuttle in its lowered operating position with the shuttle arm extended and the clip 10*c* held in alignment with the hole in the shoulder 26. It is to be understood that three additional clip shuttles will be operating for the substantially simultaneous positioning of four clips on one tie.

Details of the end of the shuttle arm 198 are shown in FIGS. 18 and 19. The clip basket 199 affixed to the end of the arm is formed with a trough portion 232 adjacent the arm end and a lip 234 extending from the trough portion toward the track rail. The trough portion 232 is dimensioned to receive the center leg and heel of a clip. The lip 234 supports the underside of the toe 12 of the clip.

A clip spring guide 236 extends into the basket trough 232 disposed between the clip heel 15 and the upright wall 238 of the trough which lies against the end of shuttle arm 198. There is a lengthwise recess formed in the shuttle arm in which is mounted an air cylinder 240. Cylinder 240 is extended to urge the clip spring guide 236 against the clip heel to firmly grasp the clip in the basket 199. Cylinder 240 is retracted to release the clip so that the clip may be driven into the shoulder.

Details of the clip driving mechanism ar shown in FIGS. 20–24. For clarity of illustration, the clip shuttle, which is normally rigidly mounted to cross member 150 on bracket 246 is not shown in FIG. 20. As described above with reference to FIG. 7, and as further shown in FIG. 20, the head assembly 144 includes a rigid framework mounted for vertical movement on guide rods 140, 142. When a clip 10*d* is to be driven into a shoulder 26, the clip is positioned in alignment by the basket at the end of the shuttle arm as in FIG. 17.

Figure 21:
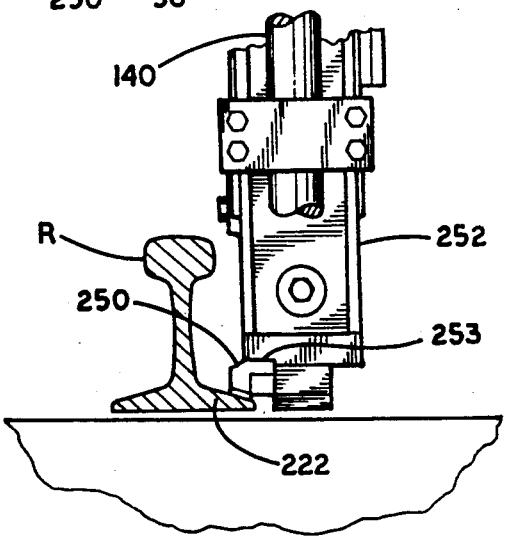
FIG. 21 is an end elevational view taken along the line XXI—XXI of FIG. 20.

When the clip applicator has been advanced along the track and positioned in approximate position over a tie, the head assembly is lowered by the action of cylinder 148. A rail flange stop 250 is affixed to the lower end of the upright member 252 of the head assembly. As best shown in FIG. 21, the rail flange stop 250 is positioned vertically directly above the toe 22 of the rail adjacent the shoulder 26 into which the clip is to be driven. The head is lowered until the rail flange stop rests atop the rail toe, thus establishing the vertical position of the clip driving mechanism as well as the clip shuttle. The rail flange stop is bolted to the bottom of the upright member 252 for removal and replacement. Adjustment of the position of the rail flange stop is accomplished by placing shims between the underside o the upright member 252 and the top of the rail flange stop at 253.

After the head is lowered into contact with the rail toe, cylinder 118 (FIG. 7) is activated to move applicator assembly 50 and the head assembly carried thereby longitudinally toward the shoulder 26. Movement of the applicator assembly is stopped when the backup block 58 contacts the shoulder. The force exerted by cylinder 118 is controlled so as not to damage the shoulder when it is contacted by the backup block and urge the backup block against the shoulder with a force to counterbalance the force exerted by the driving of the clip into the shoulder.

Clip drive block 56 is affixed to the underside of ram head 256. The ram head is mounted for longitudinal reciprocating sliding movement on upper and lower guide rods 258 and 260. Driving motion of the ram head and clip drive block is provided by longitudinally oriented hydraulic cylinder 262 having one end attached to the lower extent of head assembly upright member 264 and the other end attached to the ram head. When the backup block is in position against the shoulder and the clip shuttle has positioned a clip in alignment with the shoulder, cylinder 262 extends to move the ram head 256 and drive block 56 to drive the clip 10*d* into the shoulder 26. To accurately limit the stroke of the drive head for the proper depth of insertion of the clip into the shoulder, limit switches 267 and 269 are mounted to the cross member 150. The limit switch 269 is contacted by a tab 265 on the ram head to signal that the driving movement should be stopped and to retract cylinder 262.

Figure 24:
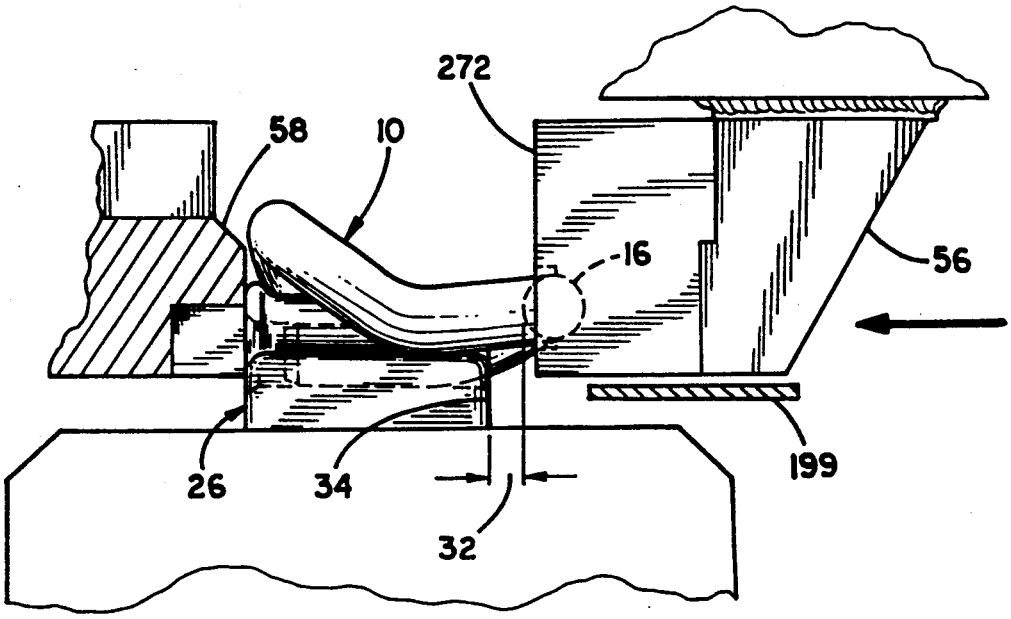
FIG. 24 is similar to FIG. 23 showing a clip fully driven into a shoulder.
Figure 22:
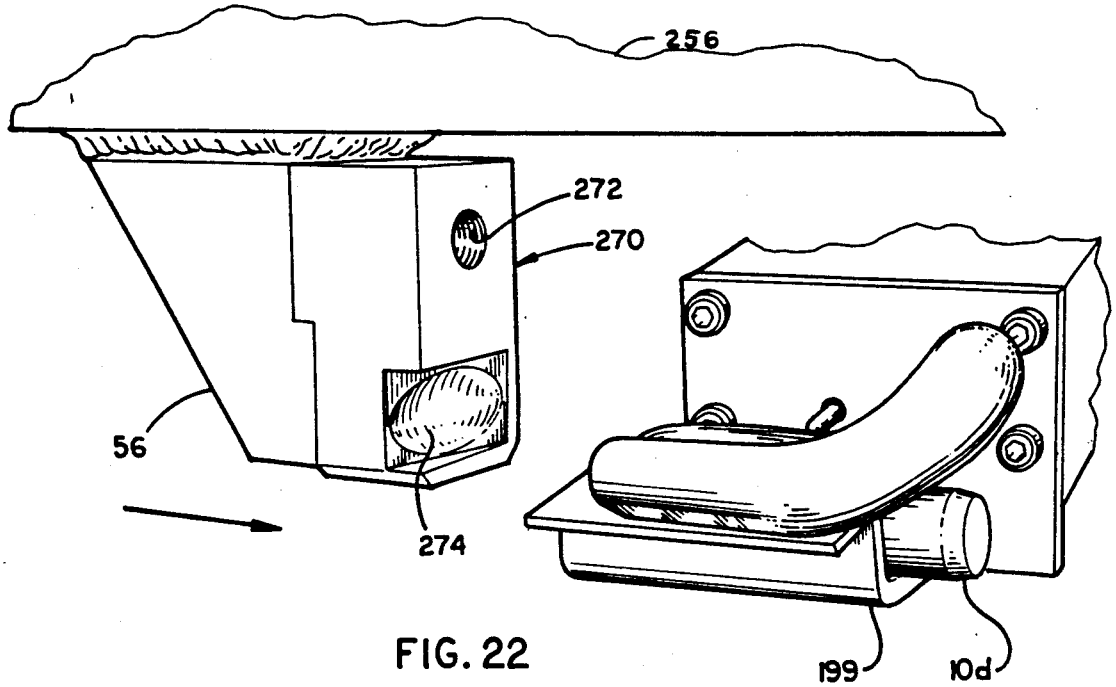
FIG. 22 is a fragmentary side perspective view showing the drive block in position for driving a clip from the clip basket into a shoulder.
Figure 23:
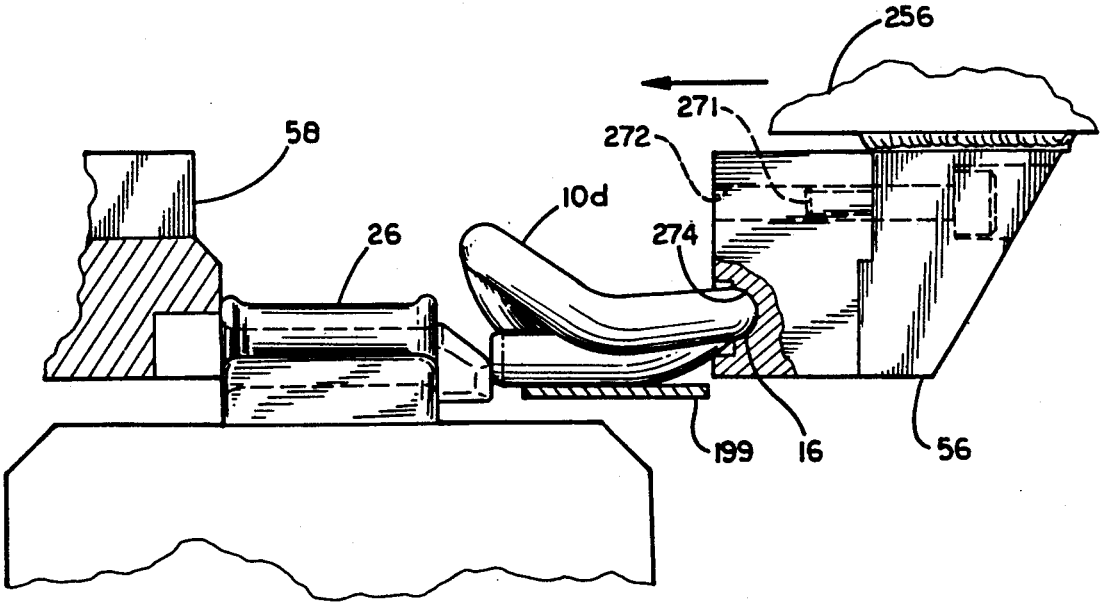
FIG. 23 is a fragmentary side elevational view showing the driving of a clip into a shoulder.

FIGS. 22 and 23 show more details of the clip drive block 56. A drive block face insert 270 is affixed to the drive block by a countersunk screw 271 in hole 272. The lower extent of the driving face of the insert 270 is formed with a concavity 274 shaped to engage the rear arch 16. The lateral width of the drive block is somewhat less that the width of the trough of the clip basket 199 so that the drive block may advance, as shown in FIG. 24, fully through the basket to drive the clip into the shoulder 26.

It may be seen the proper gap 32 (FIG. 24) between the clip rear arch 16 and the face 34 of the shoulder is obtained by the common mounting of the backup block 58 and the drive block 56 to the head assembly and to the action of limit switch 269.

Figure 28:
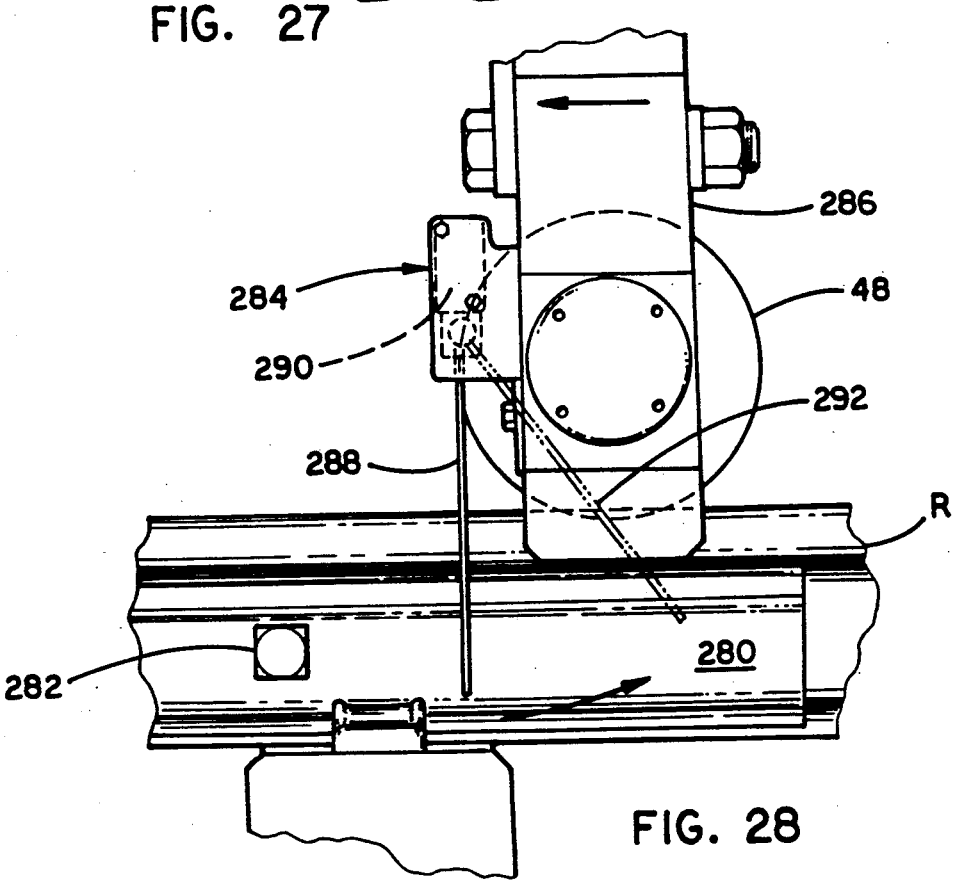
FIG. 28 is a side elevational view of the tie bar sensor.

Modern railroad track tends to have welded track joints so that the weld joint itself has little or no effect on the profile of the rail. On such track, the apparatus described above operates continuously and without interruption. However, some rail, such as around terminals and switch yard, may have the rail sections joined at the joints by tie bars. As shown in FIGS. 27 and 28, such tie bars 280 and the heads of the bolts 282 securing the tie bars protrude laterally from the web of the rail R a distance sufficient to interfere with the operation of clip applicator.

A tie bar sensor 284 (also shown in FIG. 4) is provided to detect and signal the presence of such interferences. A sensor is mounted to the supporting structures 286 for each of two leading index wheels 48. A sensor rod lever 288 hangs downwardly along the outer side of the rail having its upper end attached to a limit switch 290. When no obstruction is present, the sensor rod lever remains vertical and undeflected. When a tie bar is encountered, the sensor rod lever is deflected, as indicated at 292, by contact with a tie bar or a bolt. A signal from the limit switch alerts the operator of an obstruction. The tie bar sensor is also able to detect any random clips which may have been manually installed ahead of the clip applicator.

As shown in FIG. 1, a flexible flap 294 may be attached to the lower end of the forward extent of the carrier frames. When the carrier frames are lowered, the flaps sweep along the tops of the ties to remove any ballast stones or other materials which may lie on the ties and would otherwise interfere with the movements of the clip applicator.

Those skilled in the art will recognize that suitable electrical, hydraulic, and pneumatic lines and controls (not shown) are required in connection with the various cylinders, sensors, and switches of the rail clip applicator.

Figure 29:
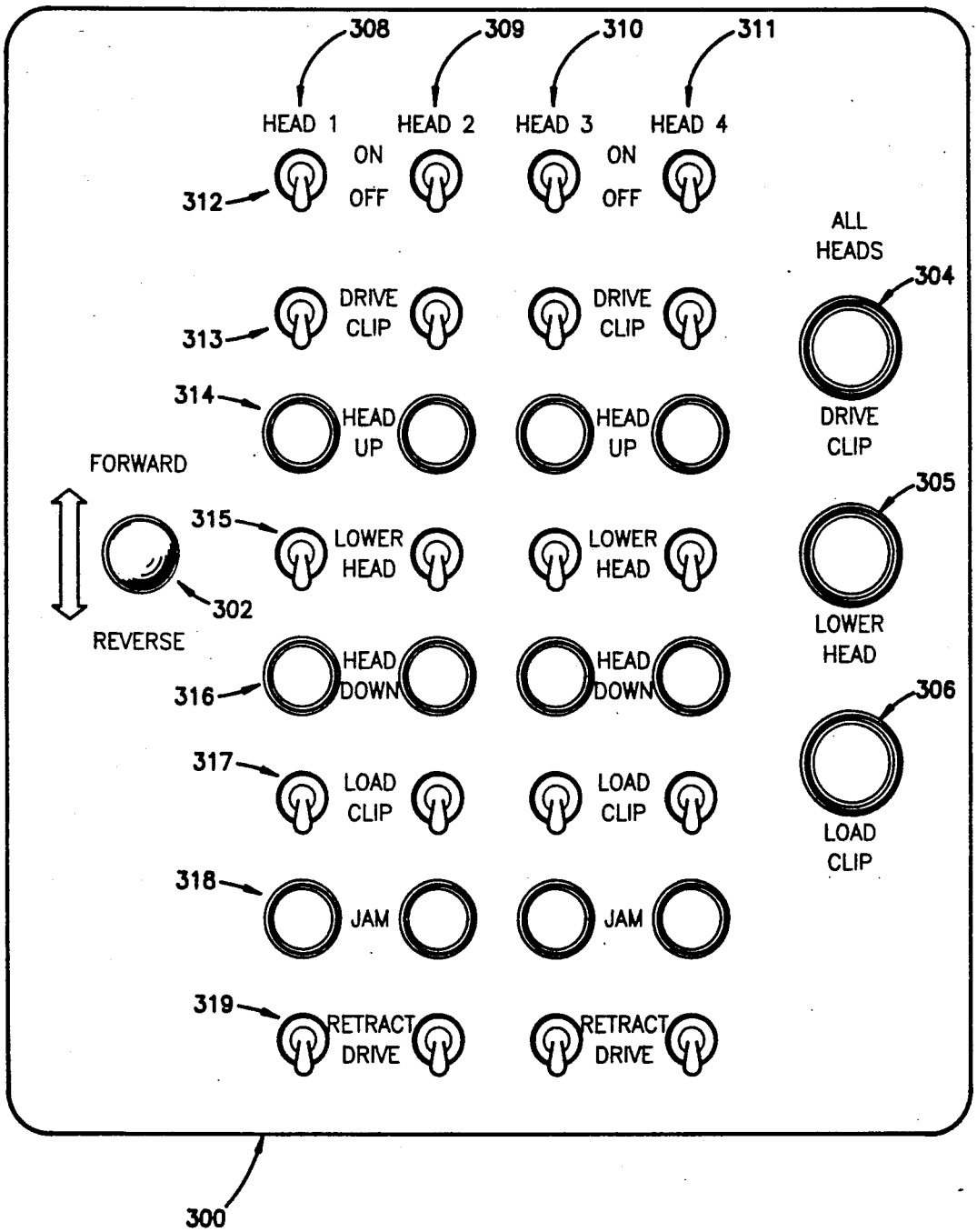
FIG. 29 is a plan view of the operator control panel.

The main functions of the rail clip applicator are controlled by the operator by means of the control panel shown in FIG. 29. At the left, there is a lever used to move the clip applicator forward or in reverse along the track. At the right, there are three buttons 304, 305, 306 used to initiate sequences of operation for all four head assemblies 144. In the center, there are four vertical columns 308–311 of switches and indicator lights, each column corresponding to a single one of the four head assemblies, it being possible to operate the applicator for applying clips to one track only, or even to only one side of one track.

Each of the columns includes the following rows of switches or lights: row 312—switch to turn head on or off; row 313—switch to move a clip basket and clip into position for driving, drive the clip into the shoulder, retract drive, lift head; row 314—indicator light confirming head assembly is lifted; row 315—switch to lower head assembly and position backup block against shoulder; row 316—indicator light confirming backup block is in place against shoulder; row 317—switch to retract and extend pusher body to load clip from magazine into shuttle basket; row 318—indicator light showing jam by improper loading of clip; row 319—switch retracting drive from shoulder. The functions of these controls are described more fully below in connection with the overall operation of the rail clip applicator.

Operation

The rail clip applicator is rolled to the worksite on its wheels 44 driven by engine 70 with the two carrier frame assemblies locked in the up position by hooks 108 (FIG. 4). The two pairs of applicator assemblies 50 are in the centered and up position on the two carrier frame assemblies locked by hooks 152. The applicator assemblies are held in the spread apart position of FIG. 10*c* by latches 164.

When the worksite is reached, hooks 108 are disengaged by the action of cylinders 110 (FIG. 4). The two carrier frame assemblies 46 are lowered by the action of cylinders 96 until the index wheels 48 rest centered upon the tops of the track rails carrying the weight of the carrier frames and the equipment mounted thereto. The vertical and lateral positions of the carrier frames are determined by the index wheels and their engagement with the rails.

The eight latches 164 (FIG. 10*c*) are rotated upward by the action of cylinders 160 to free the applicator assemblies 50 to rotate inward. The action of the four cylinders 122 rotates the applicator assemblies inward until the eight web guide rollers 146 are in contact with the webs of the rails as in FIG. 10*b*. Pressure is maintained in cylinders 122 to keep the web guide rollers in contact with the rail webs, thus aligning the applicator assemblies longitudinally with the rails.

Hooks 152 (FIG. 7) are withdrawn by the action of cylinders 154 to free the four head assemblies 144 for vertical movement on guide rods 140, 142 on the applicator assemblies. Upstop 156 is rotated by the action of cylinder 158 into position above the upper end of member 252 for detecting the upper limit of vertical travel of the head assembly.

The boom 60 (FIG. 2) and basket 64 are used to load a supply of clips from a tender car into the lower infeed end of the conveyor 66. The conveyor carries the clips upward into the hopper 68. Clip loaders stationed in seats 74 and 76 pick clips from the hopper and drop them into the upper end openings 78–81 (FIG. 3) of the four upper magazine extensions. The clips drop into nested position in the magazines (FIG. 12) until the uppermost clips bear on the lever 184 to raise the flags 188 and signal the clip loaders that the magazines are full.

The clip magazine pusher bodies 202 are normally in the position of FIG. 13*b* extended under the bottommost clips in the magazines. The shuttle arms and baskets 199 are in the retracted position of FIG. 16. The operator presses the "load clip" pushbutton 306 which retracts the four magazine cylinders 208 and the pusher bodies allowing the bottommost clips to drop in front of the pusher bodies as in FIG. 13*a*. Hydraulic cylinders 208 then immediately re-extend causing the pusher bodies to load the bottommost clips into the baskets 199 at the ends of the shuttle arms. The pusher bodies remain in the position of FIG. 13*b* until the next clip loading cycle is demanded The operator stationed in seat 72 moves the lever 302 of the control panel to move the clip applicator forward. The operator releases the lever 302 when he/she visually determines that the machine is in approximate position over the first (or next) tie to which the rails are to be secured. Stopping the machine automatically sets the brakes.

The operator then presses the "lower head" pushbutton 305. This initiates a sequence which activates the four cylinders 148 (FIG. 7) to lower the head assemblies until the four rail flange stops 250 (FIG. 20) contact the tops of the rail toe thus establishing the vertical positions of the head assemblies with respect to the rails. Limit switches 149*b* signal that the head assemblies are lowered. Pressure switches associated with the hydraulic lines to cylinders 148 sense that the equipment is ready for the next step in the sequence.

Figure 20:
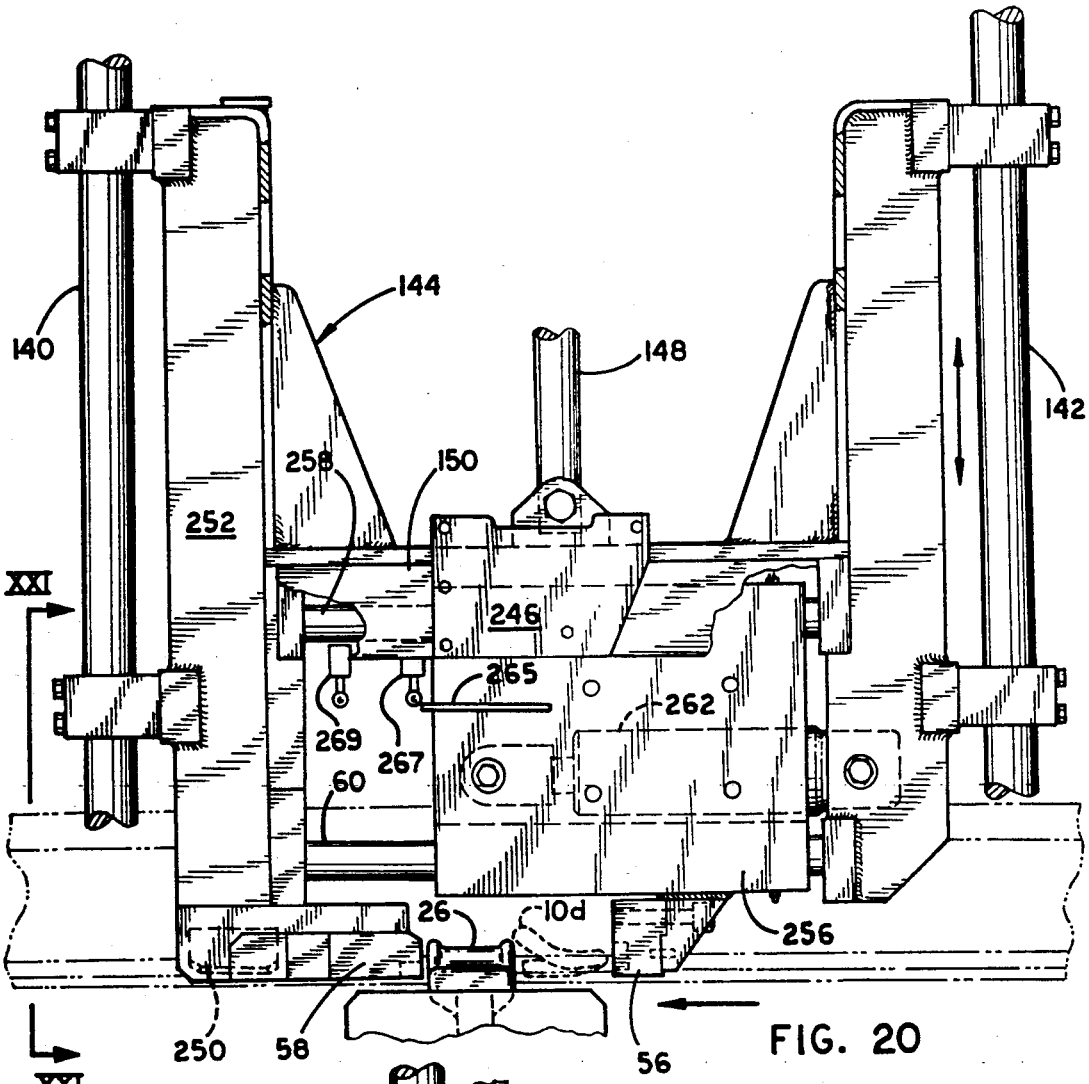
FIG. 20 is a side elevational view, with the clip shuttle removed, of the head assembly and clip driving mechanism.

The sequence continues with the activation of the cylinders 118 (FIG. 4) to move the applicator assemblies longitudinally on carrier shafts 116 until the backup blocks 58 contact the tie shoulders as in FIG. 20. Pressure switches associated with the hydraulic lines to the cylinders sense that the backup blocks are in position and light "head down" indicator lights 316.

The operator next presses "drive clip" pushbutton 304. This activates the cylinders 220 to extend the four shuttle arms 198 into the positions of FIG. 17 in which the clips are held by the baskets 199 in readiness for being driven into the shoulders. Limit switches 227 confirm that the clips are in position for driving.

The signals of limit switches 227 energize the four hydraulic cylinders 262 (FIG. 20) to move the ram heads and the drive blocks 56 and to drive the clips into the shoulders. The limit switches 269 signal that the ram heads have completed their strokes and that the clips have been driven. Pressure switches in the hydraulic lines to the cylinders 262 monitor the driving pressures and halt the driving sequence should a blockage be indicated by excessive pressure buildup. The limit switches 269 and pressure switch signals jointly confirm that the clips have been driven in and initiate the head lift and drive retract cycle.

The head lift cycle is initiated by reversal of hydraulic cylinders 148 to raise the head assemblies to ready positions for indexing to the next tie. The limit switches 149*a* (FIG. 7) confirm that the head assemblies have been raised. The drive retract cycle is initiated by reversal of hydraulic cylinders 262 to retract the ram heads. The limit switches 267 confirm that the ram heads have been fully retracted.

The signals from the limit switches 267 initiate reversal of air cylinders 220 to retract the shuttle arms into the loading positions of FIG. 16. Limit switches 226 confirm that the shuttle arms are fully retracted.

The signals from limit switches 149*a* (FIG. 7) initiate re-centering of the carriage assemblies by retracting cylinders 118 until the limit switches 137 contact the collars 139 and lighting indicator lights 314. The rail clip applicator is now in readiness for loading four more clips, indexing forward to the next tie, and repeating the clip applying steps described above.

During the progress of the clip applicator along the track, the clip loaders will observe the flags on the clip magazine extensions and drop additional clips into the magazine extensions as required.

The above description is that of a preferred embodiment of the invention. Various alterations and changes can be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. A rail clip applicator for inserting spring clips into tie shoulders of a railway track comprising:

a first carrier frame adapted for rolling along a track rail in longitudinal alignment therewith;

an applicator assembly carried by said carrier frame and mounted for longitudinal movement with respect to said carrier frame;

clip magazine means carried by said applicator assembly for containing the clips and dispensing a series of clips at a lateral distance from the track rail;

a head assembly carried by said applicator assembly and mounted for vertical movement with respect to said applicator assembly;

clip shuttle means carried by said head assembly for receiving clips dispensed from said magazine means, for moving the clips received therein away from said magazine means toward the track rail, and for placing said clips adjacent the tie shoulders in position for insertion therein;

backup block means carried by said head assembly for pressing against the tie shoulders opposite the clips to be inserted;

drive block means carried by said head assembly and mounted for longitudinal movement thereon for driving clips held in position by said clip shuttle means into said tie shoulders.

2. The rail clip applicator of claim 1 further comprising a first pair of said head applicator assemblies carried by said carrier frame in back-to-back relationship disposed on either lateral side of a track rail, each of said pair carrying a said clip magazine means, head assembly, clip shuttle means, backup block means, and drive block means for substantially simultaneously driving clips into two tie shoulders disposed on either side of said track rail.

3. The rail clip applicator of claim 2 wherein said each of said first pair of applicator assemblies is mounted to said carrier frame for lateral movement toward the track rail to make contact with the track rail and maintain the applicator assembly laterally in a clip applying position with respect to the track rail and for lateral movement away from the track rail to provide clearance and maintain the applicator assembly in a nonoperative transport position.

4. The rail clip applicator of claim 2 further comprising a second carrier frame for rolling along a parallel second track rail in longitudinal alignment therewith, said second carrier frame carrying a second pair of said head applicator assemblies in back-to-back relationship disposed on either lateral side of the second track rail, each of said second pair carrying a said clip magazine means, head assembly, clip shuttle means, backup block means, and drive block means for substantially simultaneously driving clips into four tie shoulders disposed on either side of both of said track rails.

5. The rail clip applicator of claim 4 wherein said each applicator assembly of said first and second pairs of applicator assemblies is mounted to a said carrier frame for lateral movement toward the respective track rail to make contact with the track rail and maintain the applicator assembly laterally in a clip applying position with respect to the track rail and for lateral movement away from the track rail to provide clearance and maintain the applicator assembly in a nonoperative transport position.

6. The rail clip applicator of claim 1 further comprising superstructure means adapted for rolling along said railway track and including drive means for advancing said rail clip applicator from tie to tie, said first carrier frame carried by said superstructure.

7. The rail clip applicator of claim 6 wherein said first carrier frame is mounted for vertical and lateral movement with respect to said superstructure and is movable into an operating position in which first carrier frame is rolling upon the track rail in said longitudinal alignment therewith and into a transport position in which said first carrier frame is raised away from said track rail.

8. The rail clip applicator of claim 6 further comprising means on said superstructure for carrying a supply of clips.

9. The rail clip applicator of claim 8 wherein said means for carrying a supply of clips comprises a hopper means disposed on the upper extent of said superstructure generally above said first carrier frame.

10. The rail clip applicator of claim 8 further comprising means on said superstructure for delivering a supply of clips to said means for carrying a supply of clips.

11. The rail clip applicator of claim 10 wherein said means for delivering a supply of clips comprises a boom and winch means.

12. The rail clip applicator of claim 10 wherein said means for delivering a supply of clips comprises a conveyor means for transporting said supply of clips upward to the upper extent of said superstructure.

13. The rail clip applicator of claim 8 further comprising means defining a clip passageway extending from said clip magazine means generally upward and having an upper passageway opening adjacent said means for carrying a supply of clips, whereby clips are serially inserted in said upper passageway opening and fall into a dispensing position in said magazine means.

14. The rail clip applicator of claim 13 further wherein said upper passageway opening is configured such that it is possible to insert said clips therein in only a single, correct orientation.

15. The rail clip applicator of claim 13 wherein the lower extent of said clip passageway comprises a nest for containing a stack of clips with the bottommost clip disposed in position for dispensing to said clip shuttle means.

16. The rail clip applicator of claim 15 wherein said clip passageway further includes means for indicating that said nest is full of clips.

17. The rail clip applicator of claim 16 wherein said means for indicating comprises a pivotable lever protruding into a lower extent of said passageway, a pivotable flag mounted adjacent an upper extent of said passageway, means linking said lever to said flag, whereby the uppermost clip in said nest causes said lever and flag to pivot thereby visually indicating that said nest is full of clips.

18. The rail clip applicator of claim 1 further comprising means on said carrier frame for detecting obstructions on said track rail that would interfere with the application of clips.

19. The rail clip applicator of claim 18 wherein said means for detecting obstructions comprises a sensor rod depending from said carrier frame disposed alongside said track rail and means for producing a signal when said sensor rod is deflected by contact with an obstruction.

20. The rail clip applicator of claim 1 further comprising means on said carrier frame for sweeping away any objects from the ties that would interfere with the application of clips.

21. A rail clip applicator for inserting spring clips into tie shoulders of a railway track comprising;

carrier means adapted for rolling along a track rail in longitudinal alignment therewith from tie to tie;

an applicator assembly mounted to said carrier means for longitudinal reciprocating movement with respect to said carrier means between a first position and a second position;

clip magazine means fixed to said applicator assembly for receiving and containing a supply of clips and including means for serially dispensing single clips therefrom;

a head assembly mounted to said applicator assembly for vertical reciprocating movement with respect to said applicator assembly between a first position and a second position;

clip shuttle means affixed to said head assembly and including a clip grasping means movable between a first position in which a clip dispensed from said clip magazine means is grasped by said clip grasping means and a second position in which a clip grasped in said clip grasping means is held adjacent a tie shoulder in position to be driven into said tie shoulder;

backup block means fixed to said head assembly movable longitudinally in conjunction with longitudinal movement of said applicator assembly between a first position in which said backup block means is spaced apart from the tie shoulder and a second position in which said backup block means is in forceful contact with the tie shoulder to resist the force exerted by driving a clip into the tie shoulder; and drive block means mounted to said head assembly for longitudinal reciprocating movement between a first position in which said drive block means is spaced apart from said clip grasping means and said tie shoulder and a second position in which clip is driven by said drive block means from said clip grasping means into said shoulder.

22. The rail clip applicator of claim 21 wherein said clip magazine means comprises means for containing said supply of clips in a stack and said means for serially dispensing comprises a reciprocating pusher bar means for serially pushing the bottommost clip in said stack out of said magazine means into said clip grasping means of said clip shuttle means.

23. The rail clip applicator of claim 21 wherein said clip magazine means further includes means for indicating that said magazine means is full of clips.

24. The rail clip applicator of claim 21 wherein said clip shuttle means further includes a shuttle arm means mounted for lateral reciprocating movement between said first and second positions of said clip grasping means, said clip grasping means carried on the end of said shuttle arm means nearest the track rail.

25. The rail clip applicator of claim 24 wherein said clip grasping means comprises a basket means conforming to the shape of a clip and allowing said drive block means to move through said basket means to drive the clip into the shoulder.

26. The rail clip applicator of claim 21 further comprising a rail stop means fixed to said head assembly in predetermined relationship with said backup block means, said rail stop means being adapted to contact the track rail upon downward movement of said head assembly to limit said downward movement and thereby establish the proper vertical position of said backup block means, said clip shuttle means, and said drive block means for driving a clip into said shoulder.

27. The rail clip applicator of claim 26 wherein said rail stop means is adapted to contact the toe of the track rail.

28. The rail clip applicator of claim 21 further comprising a superstructure means adapted for rolling along both of the track rails of the railway track, said carrier means mounted to said superstructure means for vertical motion therewith between a raised transport position and a lowered operating position.

29. The rail clip applicator of claim 28 wherein said carrier means is mounted to said superstructure means for lateral motion therewith for alignment with said track rail.

30. The rail clip applicator of claim 28 further comprising a second applicator assembly mounted to said carrier means in back-to-back relationship with said applicator assembly, second clip magazine means, a second head assembly, second clip shuttle means, second backup block means, and second drive block means disposed for driving clips into a tie shoulder on the lateral side of the track rail opposite said applicator assembly.

31. The rail clip applicator of claim 30 further comprising a second carrier means mounted to said super structure for vertical and horizontal motion therewith between a raised transport position and a lowered operating position in alignment with a second track rail, third and forth applicator assemblies mounted to said second carrier means in back-to-back relationship with each other, third and fourth clip magazine means, third and fourth head assemblies, third and fourth clip shuttle means, third and fourth backup block means, and third and fourth drive block means disposed for driving clips into tie shoulders on both lateral sides of the second track rail, whereby four clips are substantially simultaneously dispensed and driven into four tie shoulders of a track tie.

32. A rail clip applicator for delivering, positioning, and inserting spring clips into shoulders of track ties for securing first and second laterally spaced apart track rails to the ties comprising:

a superstructure adapted for rolling along the track rails from tie to tie;

first and second carrier means carried by said superstructure in laterally spaced relationship and mounted thereto for vertical and lateral movement with respect to said superstructure, each of said carrier means movable between a raised transport position and a lowered operating position in which said first and second carrier means are in alignment with said first and second track rails respectively;

first, second, third, and fourth applicator assemblies, each of said first and second carrier means carrying a pair of said applicator assemblies mounted to said carrier means in back-to-back relationship for longitudinal reciprocating movement with respect to said carrier means, each of said pair disposed on opposite lateral sides of one of said track rails;

first, second, third, and fourth clip magazine means, each of said applicator assemblies carrying one of said clip magazine means for receiving and containing a supply of clips and for serially dispensing single clips therefrom for insertion into the shoulder on one side of one track rail;

first, second, third, and fourth head assemblies, each of said head assemblies mounted to a said applicator assembly for vertical reciprocating movement with respect to said applicator assembly;

first, second, third, and fourth clip shuttle means, each of said clip shuttle means affixed to a said head assembly in operative association with a said clip magazine means, each said clip shuttle means including a clip grasping means movable between a first position in which a clip dispensed from said clip magazine means is received and grasped by said clip grasping means and a second position in which the clip grasped thereby is held in alignment with a tie shoulder in position to be driven into said tie shoulder;

first, second, third, and fourth backup block means, each of said backup block means affixed to a said applicator assembly movable longitudinally in conjunction with longitudinal movement of said applicator assembly between a first position in which said backup block means is spaced apart from a tie shoulder and a second position in which said backup block means is in forceful contact with the tie shoulder to resist the force exerted by the driving of a clip into the tie shoulder; and first, second, third, and fourth drive block means, each of said drive block means mounted to a said head assembly for longitudinal reciprocating movement from a first position in which said drive block means is spaced apart from a tie shoulder with a clip grasped by said grasping means disposed between said shoulder and said drive block means and a second position in which said clip is driven by said drive block means from said grasping means into the tie shoulder.

33. The clip applicator of claim 32 wherein each of said applicator assemblies is mounted for lateral movement with respect to a track rail and to the other applicator assembly of the pair, whereby each applicator assembly of a pair may moved apart from the track rail to a transport position and toward the track rail to an operating position.

34. The clip applicator of claim 33 wherein each of said applicator assemblies includes guide means for establishing the said operating position of said applicator assembly.

35. The clip applicator of claim 34 wherein said guide means comprises at least one roller mounted to said applicator assembly disposed for laterally contacting the track rail.

36. The clip applicator of claim 33 further comprising latch means for maintaining and releasing said transport position of said applicator assemblies.

37. The clip applicator of claim 32 further comprising means on said superstructure disposed generally above said clip magazine means for carrying a supply of clips.

38. The clip applicator of claim 37 further comprising means on said superstructure for delivering clips to said means for carrying a supply of clips.

39. The clip applicator of claim 37 wherein each of said clip magazine means includes a clip passageway having an upper end disposed adjacent said means for carrying a supply of clips.

40. The clip applicator of claim 39 wherein each of said clip passageways has an upper end opening configured to allow the insertion of clips in only a single, correct orientation.

41. The clip applicator of claim 39 further comprising means operatively associated with clip passageway for indicating that the clip magazine means has a full supply of clips.

42. The clip applicator of claim 32 wherein each of said clip magazine means is configured for containing a stack of clips and includes a longitudinally reciprocating pusher means for ejecting the bottommost clip in said stack out of said clip magazine means into said clip grasping means when said clip grasping means is in its first position.

43. The clip applicator of claim 32 wherein each of said clip shuttle means includes a laterally reciprocating arm means, said grasping means mounted to an end of said arm means, said grasping means being in its first position when said arm means is retracted away from the track rail and said head assembly is in a raised position, said grasping means being in its second position when said arm means is extended toward said track rail and said assembly is in a lowered position.

44. The clip applicator of claim 32 further comprising a rail stop means fixed to each of said head assemblies in predetermined relationship with said backup block means, said rail stop means being adapted to contact the track rail upon downward movement of said assembly to limit said downward movement and thereby establish the proper vertical position of said backup block means, said clip shuttle means, and said drive block means for driving a clip into a tie shoulder.

45. The clip applicator of claim 44 wherein each of said rail stop means is adapted to contact the toe of the track rail.

46. A method for applying spring clips to the shoulders of rail ties for securing a track rail to the ties comprising the steps of:

carrying a supply of clips along the track rail;

loading clips from said supply into a clip magazine;

positioning a clip grasping shuttle in a first position for receiving a clip from said clip magazine at a lateral distance from the track rail;

dispensing a clip from the magazine into the clip grasping shuttle;

moving the clip grasping shuttle laterally from said first position to a second position in adjacency to a shoulder with the clip in alignment therewith;

positioning a backup block in forceful contact with the side of the shoulder opposite the clip;

moving a drive block so as to drive the clip from the shuttle into the shoulder;

advancing to a next tie;

repeating said steps of loading, positioning the clip grasping shuttle, dispensing, moving the clip grasping shuttle, positioning the backup block, moving the drive block and advancing.

47. The method of claim 46 wherein said steps of loading, positioning the clip grasping shuttle, dispensing, moving the clip grasping shuttle, positioning the backup block, moving the drive block and advancing are performed to apply clips substantially simultaneously to the two shoulders at either side of a track rail.

48. The method of claim 46 wherein said steps of loading, positioning the clip grasping shuttle, dispensing, moving the clip grasping shuttle, positioning the backup block, moving the drive block and advancing are performed to apply clips substantially to the four shoulders at either side of each of a pair of track rails.

49. Apparatus for applying spring clips to the shoulders of rail ties for securing a track rail to the ties comprising:

superstructure means for advancing along the track rail from tie to tie;

clip dispensing means carried on said superstructure means disposed laterally spaced apart from the track rail;

clip grasping means carried on said superstructure means for receiving a clip dispensed from said clip dispensing means, moving the clip away from said clip dispensing means and laterally toward said track rail, and grasping and positioning the clip adjacent a shoulder with the clip in alignment therewith;

backup block means carried on said superstructure means for making forceful contact with the side of the shoulder opposite the clip;

drive block means carried on said superstructure means for driving the clip from the clip grasping means into the shoulder.

50. The apparatus of claim 49 further comprising means carried on said superstructure for carrying a supply of clips.

51. The apparatus of claim 50 wherein said clip dispensing means comprises magazine means carried on said superstructure for receiving clips from said means for carrying a supply of clips and for serially dispensing clips carried thereby to said clip grasping means.

52. The apparatus of claim 49 further comprising a plurality of said clip dispensing means, said clip grasping means, said backup block means, and said drive block means for driving clips into a plurality of shoulders substantially simultaneously.

53. The apparatus of claim 52 further comprising means carried on said superstructure for carrying a supply of clips.

54. The apparatus of claim 53 wherein said plurality of said clip dispensing means comprises a plurality of magazine means carried on said superstructure for receiving clips from said means for carrying a supply of clips and for serially dispensing clips carried thereby to each of said plurality of clip grasping means.

55. A rail clip applicator for inserting spring clips into tie shoulders of a railway track comprising:

a first carrier frame adapted for rolling along a track rail in longitudinal alignment therewith;

an applicator assembly carried by said carrier frame and mounted for longitudinal movement with respect to said carrier frame;

clip magazine means carried by said applicator assembly for containing and dispensing a series of clips;

a head assembly carried by said applicator assembly and mounted for vertical movement with respect to said applicator assembly;

clip shuttle means carried by said head assembly for receiving clips dispensed from said magazine means and for placing said clips adjacent the tie shoulders in position for insertion therein;

backup block means carried by said head assembly for pressing against the tie shoulders opposite the clips to be inserted;

drive block means carried by said head assembly and mounted for longitudinal movement thereon for driving clips held in position by said clip shuttle means into said tie shoulders;

superstructure means adapted for rolling along said railway track and including drive means for advancing said rail clip applicator from tie to tie, said first carrier frame carried by said superstructure;

means on said superstructure for carrying a supply of clips;

means defining a clip passageway extending from said clip magazine means generally upward and having an upper passageway opening adjacent said means for carrying a supply of clips, whereby clips are serially inserted in said upper passageway opening and fall into a dispensing position in said magazine means, the lower extent of said clip passageway comprising a nest for containing a stack of clips with the bottommost clip disposed in position for dispensing to said clip shuttle means; and means for indicating that said nest is full of clips comprising a pivotable lever protruding into a lower extend of said passageway, a pivotable flag mounted adjacent an upper extent of said passageway, and means linking said lever to said flag, whereby the uppermost clip in said nest causes said lever and flag to pivot thereby visually indicating that said nest is full of clips.

56. A rail clip applicator for inserting spring clips into tie shoulders of a railway track comprising:

a carrier frame adapted for rolling along a track rail in longitudinal alignment therewith;

clip magazine means carried on said carrier frame for containing and dispensing a series of clips;

applicator means carried on said carrier frame for inserting clips dispensed from said clip magazine means into the tie shoulders;

means disposed above said clip magazine means for carrying a supply of clips;

means defining a clip passageway extending from said clip magazine means generally upward and having an upper passageway opening adjacent said means for carrying a supply of clips, whereby clips are serially inserted in said upper passageway opening and fall into a dispensing position in said magazine means, the lower extent of said clip passageway comprising a nest for containing a stack of clips with the bottommost clip disposed in position for dispensing to said applicator means; and means for indicating that said nest is full of clips comprising a pivotable lever protruding into a lower extent of said passageway, a pivotable flag mounted adjacent an upper extent of said passageway, means linking said lever to said flag, whereby the uppermost clip in said nest causes said lever and flag to pivot thereby visually indicating that said nest is full of clips.

57. A rail clip applicator for inserting spring clips into tie shoulders of a railway track comprising:

a first carrier frame adapted for rolling along a track rail in longitudinal alignment therewith;

an applicator assembly carried by said carrier frame and mounted for longitudinal movement with respect to said carrier frame;

clip magazine means carried by said applicator assembly for containing and dispensing a series of clips;

a head assembly carried by said applicator assembly and mounted for vertical movement with respect to said applicator assembly;

clip shuttle means carried by said head assembly for receiving clips dispensed from said magazine means and for placing said clips adjacent the tie shoulders in position for insertion therein;

backup block means carried by said head assembly for pressing against the tie shoulders opposite the clips to be inserted;

drive block means carried by said head assembly and mounted for longitudinal movement thereon for driving clips held in position by said clip shuttle means into said tie shoulders; and means on said carrier frame for detecting obstructions on said track rail that would interfere with the application of clips, said means for detecting obstructions comprising a sensor rod depending from said carrier frame disposed alongside said track rail and means for producing a signal when said sensor rod is deflected by contact with an obstruction.

* * * * *